US009939121B2

(12) United States Patent
Park

(10) Patent No.: US 9,939,121 B2
(45) Date of Patent: Apr. 10, 2018

(54) LIGHT DISTRIBUTING DEVICE FOR VEHICLE

(71) Applicant: LG Electronics Inc., Seoul (KR)

(72) Inventor: Jun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/666,786

(22) Filed: Aug. 2, 2017

(65) Prior Publication Data

US 2018/0038567 A1 Feb. 8, 2018

(30) Foreign Application Priority Data

Aug. 2, 2016 (KR) ..... 10-2016-0098651

(51) Int. Cl.
*F21S 8/10* (2006.01)

(52) U.S. Cl.
CPC ..... *F21S 48/17* (2013.01); *F21S 48/115* (2013.01); *F21S 48/12* (2013.01); *F21S 48/13* (2013.01)

(58) Field of Classification Search
CPC ..... F21S 48/115; F21S 48/12; F21S 48/13; F21S 48/17
See application file for complete search history.

(56) References Cited

U.S. PATENT DOCUMENTS 8,690,406 B2 4/2014 Drenten et al.

FOREIGN PATENT DOCUMENTS

| | | |
|---|---|---|
| JP | 2003217316 | 7/2003 |
| JP | 2003331612 | 11/2003 |
| JP | 4970136 | 7/2012 |
| JP | 5172987 | 3/2013 |
| JP | 2015076364 | 4/2015 |
| JP | 5891858 | 3/2016 |
| JP | 6069762 | 2/2017 |
| KR | 10-2010-0119505 | 11/2010 |
| WO | 2016095927 | 6/2016 |

OTHER PUBLICATIONS

Korean Notice of Allowance in Korean Application No. 10-2016-0098651, dated Jun. 21, 2017, 7 pages (with English translation).

*Primary Examiner* — Thomas M Sember
(74) *Attorney, Agent, or Firm* — Fish & Richardson P.C.

(57) ABSTRACT

A light distributing device for a vehicle includes a focusing lens that concentrates light input to a rear surface thereof to form an image point on a front side thereof, a shield that is arranged at the image point and has an opening through which a portion of the light, which passes through the image point, passes, and a mirror that reflects at least a portion of the light that passed through the opening to the front side of the focusing lens.

20 Claims, 24 Drawing Sheets

LIGHT DISTRIBUTING DEVICE FOR VEHICLE

CROSS-REFERENCE TO RELATED APPLICATIONS

The present application claims priority under 35 U.S.C. 119 and 35 U.S.C. 365 to Korean Patent Application No. 10-2016-0098651, filed Aug. 2, 2016, which is hereby incorporated by reference in its entirety.

BACKGROUND

The present disclosure relates to a light distributing device for a vehicle, and more particularly to a light distributing device for a vehicle that shields a portion of light irradiated from a light source and projects the light to the outside.

In general, a vehicle is equipped with a light distributing device, such as a lamp, which increases a surrounding intensity of illumination to enhance the field of view of the driver during driving of the vehicle or inform the outside of a current driving state.

The light distributing device (hereinafter, referred to as a light distributing device for a vehicle) installed in the vehicle may be used for a headlamp that irradiates light to the front side of the vehicle, a rear lamp that displays a travel direction of the vehicle or informs a manipulation of a brake, and the like.

The light distributing device for a vehicle may form a low beam or a high beam for securing the view of field of the driver, and LEDs having high power efficiency and long lifespan have recently been increasingly used as a light source.

Meanwhile, laser diodes, of which the irradiation distance is longer than that of the LEDs, also may be used as a light source of the light distributing device for a vehicle.

PRIOR TECHNICAL DOCUMENTS

Patent Documents

KR 10-2016-012470 KR (Published on Feb. 3, 2016)

SUMMARY

Embodiments provide a light distributing device for a vehicle that may have a smaller number of components and may be made compact.

In accordance with an aspect of the present disclosure, there is provided a light distributing device for a vehicle including a focusing lens that concentrates light input to a rear surface thereof to form an image point on a front side thereof, a shield that is arranged at the image point and has an opening through which a portion of the light, which passes through the image point, passes, and a mirror that reflects at least a portion of the light that passed through the opening to the front side of the focusing lens.

A front surface of the focusing lens may be a flat surface and the shield may be parallel to the front surface of the focusing lens.

The shield may have a plurality of openings.

The focusing lens, the shield, and the mirror may be arranged in a sequence of the focusing lens, the shield, and the mirror along a direction in which the light input to the rear surface of the focusing lens is output.

A front surface of the focusing lens may be a flat surface and the mirror may be perpendicular to the front surface of the focusing lens.

The mirror may include a reflective surface that reflects the light that passes through the image point and the reflective surface of the mirror may be spaced apart from an optical axis of the focusing lens by a predetermined distance.

The light distributing device may further include a collimator lens that is arranged on a rear side of the focusing lens to output the light input to a rear surface thereof as parallel rays.

The front surface of the focusing lens may be a flat surface, the rear surface of the collimator lens may be a flat surface, and the front surface of the focusing lens and the rear surface of the collimator lens may be parallel to each other.

The light distributing device may further include a projection lens that is arranged on the front side of the focusing lens.

The front surface of the focusing lens may be a flat surface, the rear surface of the projection lens may be a flat surface, and the front surface of the focusing lens and the rear surface of the projection lens may be parallel to each other.

The focusing lens may form a focus on the front side thereof, and the focus may be situated between the projection lens and the focusing lens.

The focusing lens, the shield, the mirror, and the projection lens may be arranged in a sequence of the focusing lens, the shield, the mirror, and the projection lens along a direction in which the light input to the rear surface of the focusing lens is output.

One side of the mirror may be attached to the shield.

The mirror and the shield may be perpendicular to each other.

The shield may include a main shield that has an opening, and a mirror shield which blocks a portion of the opening and on which the mirror is mounted.

A seating part may protrude from the shield and the mirror may be seated on the seating part.

The light distributing device may further include a mirror elevating device that elevates the mirror.

The light distributing device may further include a mirror rotating device that rotates the mirror about a rotational axis, and the rotational axis is perpendicular to the shield.

The light distributing device may further include a mirror rotating device that rotates the mirror about a rotational axis, and the rotational axis may be parallel to an optical axis of the focusing lens.

DETAILED DESCRIPTION OF THE EMBODIMENTS

Hereinafter, exemplary embodiments of the present disclosure will be described in detail with reference to the accompanying drawings.

Herein, a light distributing device for a vehicle may be used as a term including a light source.

Figure 1:
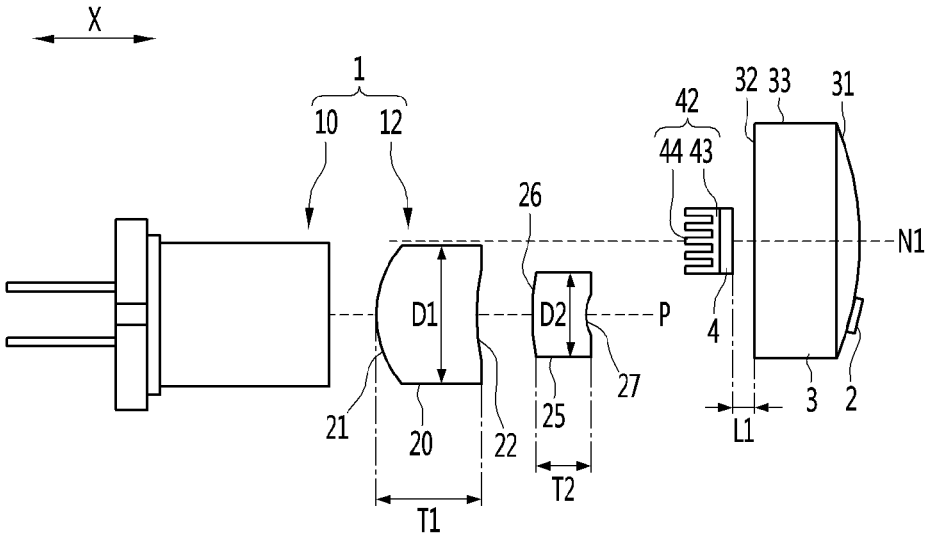
FIG. 1 is a diagram illustrating a light source unit of a light distributing device for a vehicle according to a first embodiment of the present disclosure.
Figure 2:
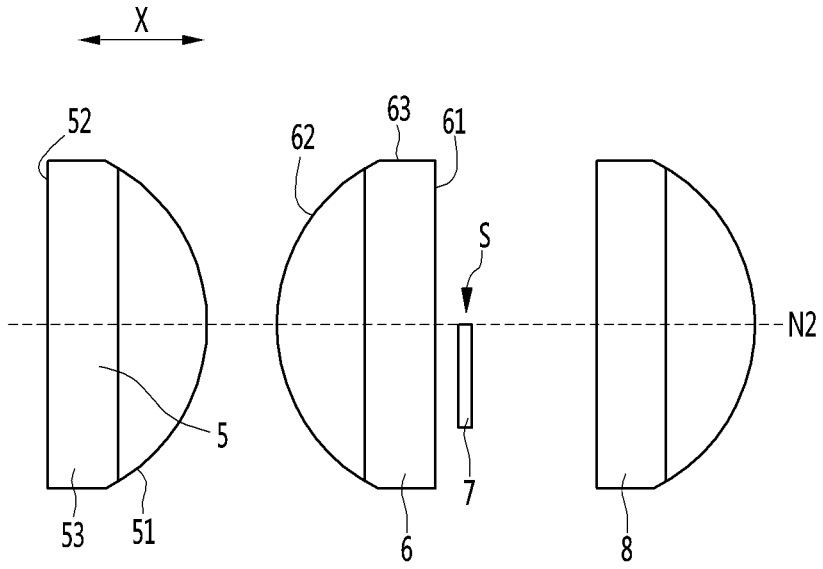
FIG. 2 is a diagram illustrating a light distributing unit of the light distributing device for a vehicle according to the first embodiment of the present disclosure.
Figure 3:
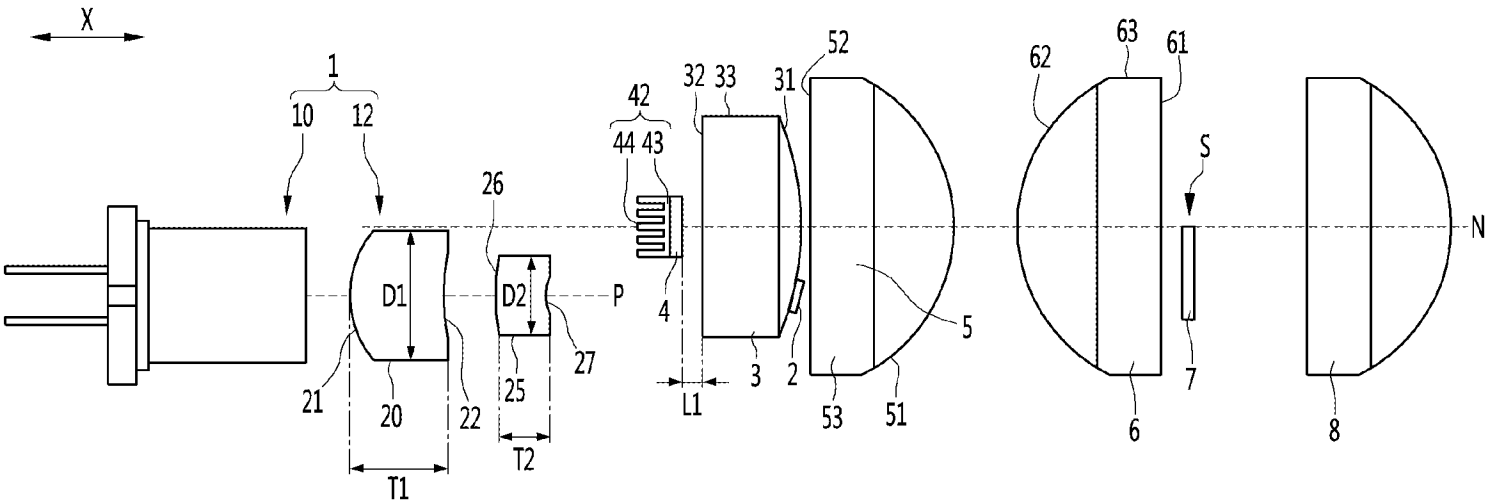
FIG. 3 is a diagram illustrating the light distributing device for a vehicle according to the first embodiment of the present disclosure.
Figure 4:
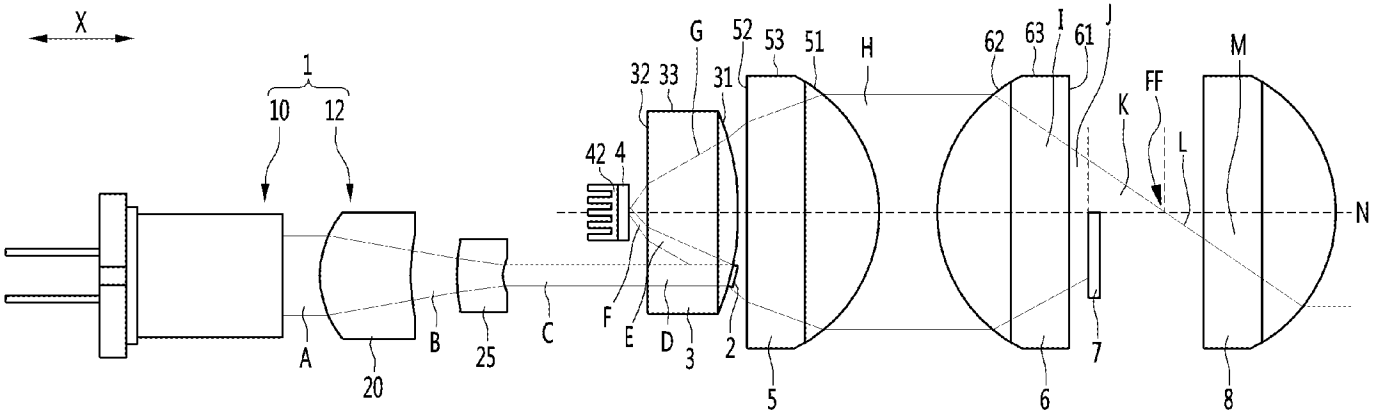
FIG. 4 is a diagram illustrating a light path of the light distributing device for a vehicle according to the first embodiment of the present disclosure.
Figure 5:
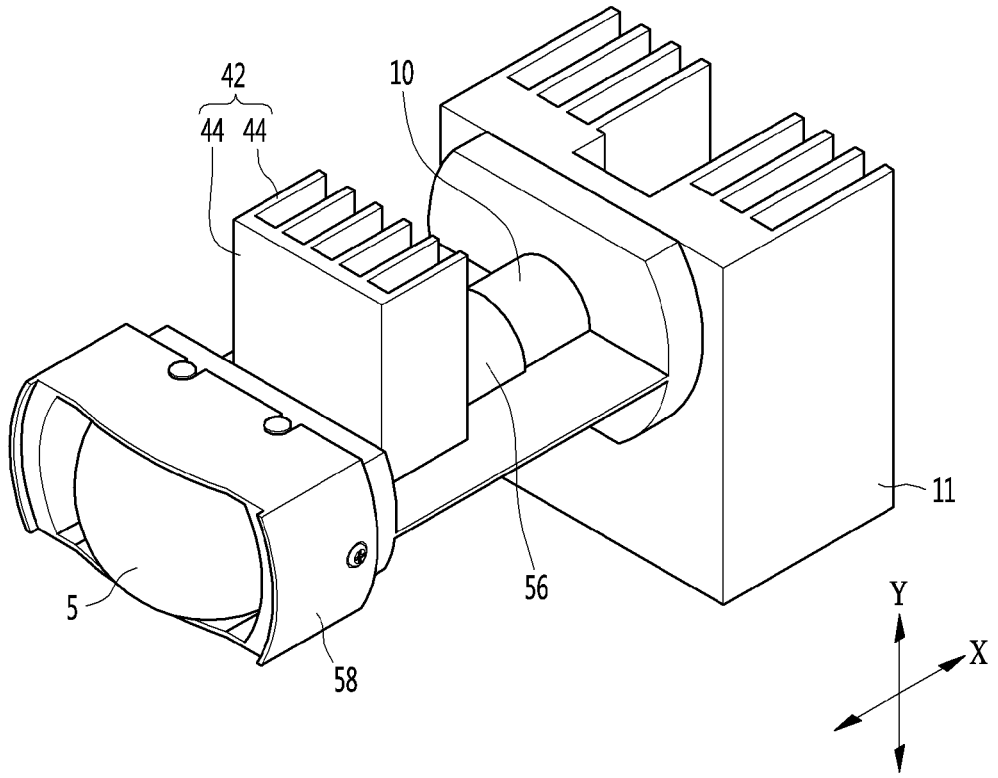
FIG. 5 is a perspective view illustrating the light distributing device for a vehicle according to the first embodiment of the present disclosure.

FIG. 1 is a diagram illustrating a light source unit of a light distributing device for a vehicle according to a first embodiment of the present disclosure. FIG. 2 is a diagram illustrating a light distributing unit of the light distributing device for a vehicle according to the first embodiment of the present disclosure. FIG. 3 is a diagram illustrating the light distributing device for a vehicle according to the first embodiment of the present disclosure. FIG. 4 is a diagram illustrating a light path of the light distributing device for a vehicle according to the first embodiment of the present disclosure. FIG. 5 is a perspective view illustrating the light distributing device for a vehicle according to the first embodiment of the present disclosure.

The light distributing device for a vehicle may include a light source device 1, a reflector 2, a lens 3, a reflective fluorescent body 4, a collimator lens 5, a focusing lens 6, and a cutoff shield 7.

The light distributing device for a vehicle may largely include a light source unit and a light distributing unit according to functions thereof. The light source unit may include a light source device 1, a reflector 2, a lens 3, and a reflective fluorescent body 4. The light source unit may further include a collimator lens 5.

The light distributing device for a vehicle may constitute a headlamp for a vehicle, and may be used as a high beam distributing device that generates a high beam or a low beam distributing device that generates a low beam.

The light source device 1 may output light towards the reflector 2. The light source device 1 may output light towards the lens 3, and the light output towards the lens 3 may pass through the lens 3 and may be input to the reflector 2. The light source device 1 may output light towards a rear surface 32 of the lens 3, and the light input to the rear surface 32 of the lens 3 may pass through the lens 3 and may be input to a rear surface of the reflector 2.

The light source device 1 may include a light source 10. The light source 10 may receive electrical energy and may convert the electrical energy to optical energy, and may be a light emitting source such as a UHV lamp, a light emitting diode, or a laser diode.

It is preferable that the light source 10 have an excellent straightness and a high efficiency and allow far distance illumination, and the light source is preferably a laser diode. It is preferable that the laser diode that is the light source 10 irradiate a blue laser ray with a high efficiency.

A heat dissipating member that dissipates heat generated by the light source 10 may be connected to the light source 10. The heat dissipating member may include a contact plate that contacts the light source 10 and heat dissipating fins that protrude from the contact plate.

The light source device 1 may further include an optical reducer 12 that reduces the size of light that exits from the light source 10 and outputs the light towards the reflector 2. The light output by the light source 10 may be output towards the reflector 2 after passing through the optical reducer 12. The optical reducer 12 will be described below in detail.

The lens 3 may be larger than the reflective fluorescent body 4 and the reflector 2, and may protect the reflective fluorescent body 4 and the reflector 2 on the front side of the reflective fluorescent body 4.

The lens 3 may have a cylindrical shape or a polyprism shape. The lens 3 may include a front surface 31, a rear surface 32, and a circumferential surface 33.

The front surface 31 of the lens 3 may be a curved surface that is convex towards the front side, and the rear surface 32 of the lens 3 may be a flat surface or a curved surface that is concave towards the front side.

The lens 3 may have an optical axis N1. The lens 3 may be a condensing lens that has a convex front surface 31, and the front surface of the lens 3 may be symmetrical with respect to the optical axis N1. Here, the optical axis N1 of the lens 3 may be a rotational symmetrical axis or a central axis of the lens 3, and may refer to a straight line that passes through the center of the front surface 31 of the lens 3 and the center of the rear surface 32 of the lens 3.

The light distributing device for a vehicle may further include a collimator lens 5 that will be arranged on the front side of the lens 3.

The collimator lens 5 may be larger than the lens 3. The optical axis of the collimator lens 5 may coincide with the optical lens N1 of the lens 3.

The collimator lens 5 may include a front surface 51, a rear surface 52, and a circumferential surface 53. The front surface 51 of the collimator lens 5 may be a curved surface that is convex towards the front side. The rear surface 52 of the collimator lens 5 may be a flat surface. The collimator lens 5 may have a structure that is symmetrical with respect to the optical axis thereof.

The reflective fluorescent body 4 may be arranged on the rear side of the lens 3, and may convert the wavelength of the light reflected by the reflector 2 and may reflect the light towards the lens 3.

The reflective fluorescent body 4 may generate heat when the wavelength of the light is converted, and it is preferable that the reflective fluorescent body 4 be spaced apart from the lens 3. The reflective fluorescent body 4 may be arranged on the rear side of the lens 3 to be spaced apart from the lens 3.

The reflective fluorescent body 4 may face the rear surface 32 of the lens 3, and may reflect light towards the rear surface 32 of the lens 3.

The reflective fluorescent body 4 may be arranged in the optical axis N1 of the lens 3 to be spaced apart from rear surface 32 of the lens 3. The front surface of the reflective fluorescent body 4 may be parallel to the rear surface 32 of the lens 3.

The reflective fluorescent body 4 may be arranged to be eccentric to the optical axis N1 of the lens 3 instead of being arranged in the optical axis N1 of the lens 3. However, because an area of the lens, through which the light reflected by the reflective fluorescent body 4 passes, in this case is smaller than in the case in which the reflective fluorescent body 4 is arranged in the optical axis N1 of the lens 3, the efficiency thereof is very low.

Further, when the reflective fluorescent body 4 is arranged to be eccentric to the optical axis N1 of the lens 3 instead of being arranged in the optical axis N1 of the lens 3, an area of the collimator lens 5, through which the light reflected by the reflective fluorescent body 4 passes, may be asymmetrical to another area of the collimator lens 5, and in this case, a manufacturing process of the collimator lens 5 may be complex and manufacturing costs of the collimator lens 5 may be increased.

However, if the reflective fluorescent body 4 is arranged in the optical axis N1 of the lens 3, the collimator lens 5 may be symmetrical with respect to the optical axis thereof and manufacturing costs of the collimator lens 5 may be decreased.

That is, it is preferable that the reflective fluorescent body 4 be arranged in the optical axis N1 of the lens 3.

The reflective fluorescent body 4 may include a wavelength converting layer that faces the rear surface 32 of the lens 3, and a reflector that is arranged on the rear side of the wavelength converting layer.

The wavelength converting layer may be a wavelength converting film, and may include an opto-ceramic. The wavelength converting layer may convert the wavelength of the light reflected by the reflector 2 while being situated on the front side of the reflector. The wavelength converting layer may be a wave length converting film that converts blue light into yellow light if the blue light is input from the outside. The wavelength converting layer may include yellow opto-ceramic.

The reflector may include a plate, and a reflective coating layer coated on an outer surface of the plate. The plate may be formed of a metal. The reflector may support the wavelength converting layer, and the light that passed through the wavelength converting layer may be reflected towards the rear surface 32 of the lens 3 by the reflector.

If the blue light is reflected to the reflective fluorescent body 4 by the reflector 2, a portion of the blue light is reflected by a surface of the wavelength converting layer, the light of the blue light, which is input to the wavelength converting layer, may be excited in the interior of the wavelength converting layer, and the light may be reflected to the front side of the wavelength converting layer by the reflector.

The blue light reflected by the surface of the wavelength converting layer and the yellow light output to the front side of the wavelength converting layer may be mixed, and white light is output to the front side of the reflective fluorescent body 4, and the white light may pass through the lens 3 and may be output towards the front side of the lens 3.

A distance L1 between the reflective fluorescent body 4 and the lens 3 may determine a depth of the light distributing device for a vehicle, and it is preferable that the reflective fluorescent body 4 be arranged close to the lens 3 within a range that minimizes damage to the lens 3 due to heat.

A heat dissipating member 42 that helps heat dissipation of the reflective fluorescent body 4 may be arranged in the reflective fluorescent body 4. The heat dissipating member 42 may include a contact plate 43 that contacts the reflective fluorescent body 4, and heat dissipating fins 44 that protrudes from the contact plate 43.

The contact plate 43 may be attached to the rear surface of the reflector to surface-contact the reflector.

Meanwhile, the reflector 2 may be provided to reflect incident light to the reflective fluorescent body 4.

The reflector 2 may be provided in the lens 3 to be integral with the lens 3, and may be provided to be spaced apart from the lens 3 separately from the lens 3.

A location of the reflector 2 may be determined according to an arrangement location of the reflective fluorescent body 4. When the reflective fluorescent body 4 is arranged on the rear side of the lens 3, the reflector 2 may be situated on the rear side of the lens 3 to be spaced apart from the lens 3, may be provided on the rear surface of the lens 3, or may be provided on the front surface of the lens 3, or may be situated on the front side of the lens 3 to be spaced apart from the lens 3.

While being arranged on the rear side of the lens 3 to be spaced apart from the lens 3, the reflector 2 may reflect the light output from the light source device 1 between the reflective fluorescent body 4 and the lens 3.

While being arranged on the rear surface of the lens 3 to be integral with the lens 3, the reflector 2 may reflect the light output from the light source device 1 between the reflective fluorescent body 4 and the lens 3.

While being arranged on the front surface of the lens 3 to be integral with the lens 3, the reflector 2 may reflect light to the lens 3 such that light that passes through the lens 3 after being output from the light source device 1 is reflected towards the reflective fluorescent body 4.

While being arranged on the front side of the lens 3 to be spaced apart from the lens 3, the reflector 2 may reflect light to the lens 3 such that light that passes through the lens 3 after being output from the light source device 1 is reflected towards the reflective fluorescent body 4.

When the reflector 2 is provided on the rear or front side of the lens 3 to be spaced apart from the lens 3, the number of components of the light distributing device for a vehicle may be increased, and the size of the light distributing device for a vehicle may be increased due to a spacing distance between the lens 3 and the reflector 2.

It is preferable that the reflector 2 be provided integrally with the rear surface 32 or the front surface 31 of the lens 3 to make the light distributing device for a vehicle compact while minimizing the number of components of the light distributing device for a vehicle.

When the reflector 2 is provided on the whole rear surface of the lens 3 or the whole front surface of the lens 3, all the light reflected by the reflective fluorescent body 4 is reflected to the rear side and the light reflected by the reflective fluorescent body 4 cannot be output to the front side of the lens 3.

That is, it is preferable that the reflector 2 be provided at a portion of the rear surface of the lens 3 or at a portion of the front surface of the lens 3. It is preferable that the reflector 2 have a size by which the lens 3 may secure a sufficient light irradiation area. It is preferable that the reflector 2 be situated at a site other than the optical axis N1 of the lens 3, and it is preferable that the reflector 2 be situated between the optical axis N1 of the lens 3 and the circumferential surface 33 of the lens 3.

The reflector 2 may be provided in an area of the rear surface of the lens 3 or in an area of the front surface of the lens 3. The reflector 2 may be provided to reflect the light output from the light source device 1 to the reflective fluorescent body 4.

The reflector 2 may reflect the incident light to the rear side of the lens 3.

It is preferable that a location of the reflector 2 be determined in consideration of the distance between the reflective fluorescent body 4 and the lens 3.

Because it is preferable that the reflective fluorescent body 4 be arranged close to the rear surface 32 of the lens 3, it is preferable that the reflector 2 be provided on the front surface 31 of the lens 3.

That is, the reflector 2 may be provided in an area of the front surface of the lens 3, and the light output by the light source device 1, in particular, the optical reducer 12 may pass through the lens 3 and may be input to the reflector 2. Further, the light reflected by the reflector 2 may pass through the lens 3 and may be input to the reflective fluorescent body 4, and the light, of which a wavelength is changed by the reflective fluorescent body 4, may pass through the lens 3 and may be irradiated to the front side. The lens 3 may be a 3-path lens through which light passes three times, and the light distributing device for a vehicle may be made compact by the 3-path lens.

The reflector 2 may be formed at a portion of the convex front surface 31 of the lens 3 along the convex front surface 31 of the lens 3, and may have an arc-shaped cross-section. The reflector 2 may have a circular or polygonal shape when viewed from the front side of the lens 3.

The reflector 2 may have a concave mirror that is formed on the front surface 31 of the lens 3. The front surface of the reflector 2 may be convex, and the rear surface of the reflector 2 may be concave.

The front surface of the reflector 2 may face the collimator lens 5, which will be described below, and the reflector 2 may be protected by the lens 3 and the collimator lens 5 between the lens 3 and the collimator lens 5.

The reflector 2 may be a reflective coating layer that is coated in an area of the front surface 31 of the lens 3 other than the optical axis N1 of the lens 3. The reflector 2 may be a reflective sheet that is attached to an area of the front surface 31 of the lens 3 other than the optical axis N1 of the lens 3.

The optical reducer 12 may be arranged between the lens 3 and the light source 10. The optical reducer 12 may be arranged between the rear surface 32 of the lens 3 and the front surface of the light source 10 to be spaced apart from the lens 3 and the light source 10.

The optical reducer 12 may be spaced apart from the optical axis N1 of the lens 3. A portion of the optical reducer 12 may be situated in the optical axis N1 of the lens 3, but the optical axis P of the optical reducer 12 may be spaced apart from the optical axis N1 of the lens 3.

The optical reducer 12 may be arranged on the rear side of the lens 3, and may output light in a direction that is parallel to the optical axis N1 of the lens 3. The optical axis P of the optical reducer 12 may be parallel to the optical axis N1 of the lens 3.

The optical reducer 12 may include a first reducer lens 20, of which an optical width is reduced as the light output from the light source 10 passes through the first reducer lens 20, and a second reducer lens 25, which is spaced apart from the first reducer lens 20 and of which an optical width is reduced as the light output from the first reducer lens 20 is output.

The first reducer lens has an incidence surface 21 and an exit surface 22, and the second reducer lens 25 has an incidence surface 26 and an exit surface 27.

The exit surface 22 of the first reducer lens 20 and the incidence surface 26 of the second reducer lens 25 may be spaced apart from each other. The exit surface 22 of the first reducer lens 20 and the incidence surface 26 of the second reducer lens 25 may be spaced apart from each other in a direction that is parallel to the optical axis N1 of the lens 3. The first reducer lens 20 and the second reducer lens 25 may be spaced apart from each other while air is interposed there between.

The first reducer lens 20 and the second reducer lens 25 may be spaced apart from each other in a forward/rearward direction. The exit surface 22 of the first reducer lens 20 and the incidence surface 26 of the second reducer lens 25 may be spaced apart from each other in a forward/rearward direction.

The first reducer lens 20 may be situated between the light source 10 and the second reducer lens 25, and the second reducer lens 25 may be situated between the first reducer lens 20 and the lens 3.

The incidence surface 21 of the first reducer lens 20 may face the light source 10.

The optical axis P of the first reducer lens 20 may coincide with the optical axis of the second reducer lens 25.

The exit surface 27 of the second reducer lens 25 may face the rear surface 32 of the first lens 3. It is preferable that the exit surface 27 of the second reducer lens 25 do not face the heat dissipating member 42 or the reflective fluorescent body 4.

The incidence surfaces of the first reducer lens 20 and the second reducer lens 25, to which light is input, may be convex. The exit surfaces of the first reducer lens 20 and the second reducer lens 25, from which light is output, may be concave.

The rear surface of the first reducer lens 20 may be an incidence surface 21, and the incidence surface 21 may be a curved surface that is convex towards the rear side. The light input from the light source 10 may be refracted by the convex incidence surface 21, and the width of the light that passes through the first reducer lens 20 may be gradually reduced as illustrated in FIG. 4.

The front surface of the first reducer lens 20 may be an exit surface 22, and the exit surface 22 may be a curved surface that is concave towards the rear side. The whole front surface of the first reducer lens 20 may be the exit surface 22 that is concave, and only a central portion of the front surface of the first reducer lens 20 may be the exit surface 22 that is concave.

A portion of the exit surface 22 of the first reducer lens 20 may face the incidence surface 26 of the second reducer lens 25.

The rear surface of the second reducer lens 25 may be an incidence surface 26, and the incidence surface 26 may be a curved surface that is convex towards the rear side. The light that passed through air between the first reducer lens 20 and the second reducer lens 25 after being output from the first reducer lens 20 may be refracted by the convex incidence surface 26 of the second reducer lens 25, and the width of the light that passed through the second reducer lens 25 may be gradually reduced.

The front surface of the second reducer lens 25 may be an exit surface 27, and the exit surface 27 may be a curved surface that is concave towards the rear side. The whole front surface of the second reducer lens 25 may be the exit surface 27 that is concave, and only a central portion of the front surface of the first reducer lens 20 may be the exit surface 27 that is concave.

The whole exit surface 27 of the second reducer lens 25 may face the rear surface 32 of the first lens 3.

A diameter D2 of the second reducer lens 25 may be smaller than a diameter D1 of the first reducer lens 20. A thickness T2 of the second reducer lens 25 may be smaller than a thickness T1 of the first reducer lens 20.

Because light is primarily reduced by the first reducer lens 20, the second reducer lens 25 may be made to be smaller than the first reducer lens 20 to increase a utility of a surrounding space.

The curvatures of the incidence surface 21 of the first reducer lens 20 and the incidence surface 26 of the second reducer lens 25 may be the same or may be different.

A degree, by which the width of the light that passes through the first reducer lens 20 is reduced, may be greatly influenced by the curvature of the incidence surface 21 of the first reducer lens 20, and the degree, by which the width of the light that passes through the first reducer lens 20 is reduced, may increase as the curvature of the incidence surface 21 of the first reducer lens 20 increases.

That is, as the curvature of the incidence surface 21 of the first reducer lens 20 increases, all the sizes of the second reducer lens 25, the reflector 2, and the lens 3 may be reduced.

The light, of which a width was primarily reduced by the first reducer lens 20, may be input to the incidence surface of the second reducer lens 25 and the light may not be excessively reduced by the incidence surface 26 of the second reducer lens 25.

When the curvature of the incidence surface 21 of the first reducer lens 20 and the curvature of the incidence surface 26 of the second reducer lens 25 are different, it is preferable that the curvature of the incidence surface 21 of the first reducer lens 20 be larger than the curvature of the incidence surface 26 of the second reducer lens 25.

The curvatures of the exit surface 22 of the first reducer lens 20 and the exit surface 27 of the second reducer lens 25 may be the same or may be different.

The width of the light output from the first reducer lens 20 may vary according to the curvature of the exit surface 22 thereof.

The exit surface 22 of the first reducer lens 20 may have a curvature that allows the light that passed through the exit surface 22 to be radiated in parallel. Further, the exit surface 22 of the first reducer lens 20 may have a curvature that allows the width of the light that passed through the exit surface 22 to be gradually reduced between the exit surface 22 of the first reducer lens 20 and the incidence surface 26 of the second reducer lens 25.

The second reducer lens 25 may vary the width of the light input to the reflector 2 according to the curvature of the exit surface 27 thereof, and it is preferable that the light that passed through the exit surface 27 of the second reducer lens 20 be input to the reflector 2 in parallel.

When the curvature of the exit surface 22 of the first reducer lens 20 and the curvature of the exit surface 27 of the second reducer lens 25 are different, it is preferable that the curvature of the exit surface 27 of the second reducer lens 25 be larger than the curvature of the exit surface 22 of the first reducer lens 20.

Meanwhile, the light distributing device for a vehicle may further include an optical reducer supporter 56 (see FIG. 5) that supports the optical reducer 12.

The optical reducer supporter 56 may surround the optical reducer 12. The optical reducer supporter 56 may extend in a direction that is parallel to the optical axis N1 of the lens 3, and a light passage, through which light passes, may be formed in the interior of the optical reducer supporter 56.

Further, the light distributing device for a vehicle may further include a lens holder 58 that supports the lens 3 and the collimator lens 5.

The light distributing unit may include a focusing lens 6, a cutoff shield 7, and a projection lens 8. The light distributing unit may further include a collimator lens 5. The collimator lens 5 may be included in the light source unit or the light distributing unit.

The collimator lens 5 may output the light input to the rear surface 32 as parallel rays. The parallel rays may be parallel to the optical axis of the collimator lens 5.

The light that is input to the rear surface 52 of the collimator lens 5 may be the light that is output by the lens 3. The light that is output by the lens 3 may not correspond to parallel rays but to radiating light.

The focusing lens 6 may be arranged on the front side of the collimator lens 5.

The optical axis N2 of the focusing lens 6 may coincide with the optical axis of the collimator lens 5. Further, the front surface 61 of the focusing lens 6 and the rear surface 52 of the collimator lens 5 may be parallel to each other.

The parallel rays may be parallel to the optical axis N2 of the focusing lens 6.

The focusing lens 6 may include a front surface 61, a rear surface 62, and a circumferential surface 63. The front surface 61 of the focusing lens 6 may be a flat surface. The rear surface 62 of the focusing lens 6 may be a curved surface that is convex towards the rear side. The focusing lens 6 may have a structure that is symmetrical with respect to the optical axis N2 thereof.

The focusing lens 6 may collect the light input to the rear surface 62 and may output the light. The focusing lens 6 may concentrate the light input to the rear surface 62 to form an image point S. The image point S of the focusing lens 6 may be formed on the front side of the focusing lens 6.

The image point S refers to a point at which all light geometrical-optically gathers. An image is formed at the image point S. If a screen 9 is placed at the image point S, an image may be formed on the screen 9.

The focusing lens 6 may collect the light input to the rear surface 62 to form a focus FF. The focus FF refers to a point at which all light that passed a lens gathers. The focus FF of the focusing lens 6 may be formed on the front side of the focusing lens 6.

The cutoff shield 7 may be arranged on the front side of the focusing lens 6. The cutoff shield 7 may be a flat member. The cutoff shield 7 may be parallel to the front surface 61 of the focusing lens 6. Further, the cutoff shield 7 may be parallel to the rear surface 52 of the collimator lens 5. Further, the cutoff shield 7 may be vertical to the optical axis N2 of the focusing lens 6.

The cutoff shield 7 may shield a portion of light that passes through the image point S of the focusing lens 6. The form of the light that passes the image point S may vary according to the form of the cutoff shield 7. Accordingly, various forms of light distributions may be implemented by varying the form of the cutoff shield 7.

The cutoff shield 7 may face a lower side of the front surface 61 of the focusing lens 6. The focusing lens 6 may be divided into an upper part and a lower part with respect to the optical axis N2. The upper side of the optical axis N2 may be the upper part and the lower side of the optical axis N2 may be the lower part.

The cutoff shield 7 may be a member including a flat surface, and the front surface 61 of the focusing lens 6 may be a flat surface. Then, the fact that the cutoff shield 7 faces the front surface 61 of the focusing lens 6 may mean that the flat surface of the cutoff shield 7 and the front surface 61 of the focusing lens 6 may be parallel to each other.

Accordingly, the cutoff shield 7 may be parallel to the focusing lens 6 and may face a lower side of the optical axis N2 of the focusing lens 6.

The light distributing unit may implement a low beam by arranging the cutoff shield 7 such that the cutoff shield 7 faces a lower side of the front surface 61 of the focusing lens 6.

The image point S of the focusing lens 6 may be spaced apart from the front surface 61 of the focusing lens 6 by a predetermined distance. Because the focusing lens 6 functions to concentrate light, the size of the light that passes through the focusing lens 6 may become smaller than before the light passes the focusing lens 6.

Accordingly, the size of the cutoff shield 7 may smaller than the size of the focusing lens 6. Further, the size of the cutoff shield 7 may smaller than the size of the front surface 61 of the focusing lens 6.

The light distributing unit may further include a projection lens 8. The projection lens 8 may include a front surface, a rear surface, and a circumferential surface. The front surface of the projection lens 8 may be a curved surface that is convex towards the front side. The rear surface of the projection lens 8 may be a flat surface. The projection lens 8 may have a structure that is symmetrical with respect to the optical axis of the projection lens 8.

The optical axis of the projection lens 8 may coincide with the optical axis N2 of the focusing lens 6. The optical axis of the projection lens 8 may coincide with the optical axis of the collimator lens 5.

The rear surface of the projection lens 8 may be parallel to the front surface 61 of the focusing lens 6. Further, the rear surface of the projection lens 8 may be parallel to the rear surface 52 of the collimator lens 5.

The cutoff shield 7 may face a lower side of the front surface 61 of the projection lens 8. The projection lens 8 may be divided into an upper part and a lower part with respect to the optical axis thereof. The upper side of the optical axis of the projection lens 8 may be the upper part and the lower side of the optical axis of the projection lens 8 may be the lower part.

The cutoff shield 7 may be a member including a flat surface, and the rear surface of the projection lens 8 may be a flat surface. Then, the fact that the cutoff shield 7 faces the rear surface of the projection lens 8 may mean that the flat surface of the cutoff shield 7 and the rear surface of the projection lens 8 may be parallel to each other.

Accordingly, the cutoff shield 7 may be parallel to the projection lens 8 and may face a lower side of the optical axis of the projection lens 8.

The projection lens 8 may be arranged such that the image point S of the focusing lens 6 is situated between the projection lens 8 and the focusing lens 6.

The focus FF of the focusing lens 6 may be formed on the front side of the focusing lens 6. Further, the projection lens 8 may be arranged such that the focus FF of the focusing lens 6 is situated between the projection lens 8 and the focusing lens 6. In the light distributing lens, the collimator lens 5, the focusing lens 6, the cutoff shield 7, and the projection lens 8 may be sequentially arranged along the X axis.

The light source unit and the light distributing unit may constitute one light distributing device. In the light distributing device, the light source unit and the light distributing unit may be sequentially arranged along the X axis direction.

The optical axis N1 of the lens 3 and the optical lens of the collimator lens 5 may coincide with each other. Further, the optical axis N1 of the lens 3 and the optical axis N2 of the focusing lens 6 may coincide with each other.

The optical axes N of the lens 3, the collimator lens 5, the focusing lens 6, and the projection lens 8 may coincide with each other.

Because the light radially output from the lens 3 is input to the rear surface 52 of the collimator lens 5, the size of the collimator lens 5 may be larger than the size of the lens 3. Further, the focusing lens 6 may be larger than the lens 3.

Hereinafter, an operation of the present disclosure will be described. Hereinafter it will be exemplified that the light source 10 outputs blue light and the reflective fluorescent body 4 changes a wavelength of light such that blue light is converted into yellow light.

First, if the light source 10 is turned on, the light source 10 may output blue light A and the light A output by the light source 10 may be input to the optical reducer 12 in parallel.

The light A output by the light source 10 in parallel may be input to the incidence surface 21 of the first reducer lens 20 and may be refracted by the incidence surface 21 of the first reducer lens 20 such that the width of the light A may be reduced.

The light refracted by the incidence surface 21 of the first reducer lens 20 may pass through the first reducer lens 20 and may be output to the exit surface 22 of the first reducer lens 20.

The light B output to the exit surface 22 of the first reducer lens 20 may be input to the incidence surface 26 of the second reducer lens 25 in parallel, or may be input to the incidence surface 26 of the second reducer lens 25 after the width of the light B may be gradually reduced between the exit surface 22 of the first reducer lens 20 and the incidence surface 26 of the second reducer lens 25.

The light input to the incidence surface 26 of the second reducer lens 25 may pass through the second reducer lens 25 and may be output through the exit surface 27 of the second reducer lens 25.

That is, the width of the light A output by the light source 10 is reduced while the light A sequentially passes through the first reducer lens 20, air between the first reducer lens 20 and the second reducer lens 25, and the second reducer lens 25, and the light C, of which the width was reduced, may be input to the rear surface 32 of the lens 3 in parallel.

The light D input to the rear surface 32 of the lens 3 may pass through a rear area of the reflector 2 of the lens 3 and may be input to the rear surface of the reflector 2, and may be reflected from the rear surface of the reflector 2 to the lens 3.

The light E reflected by the reflector 2 may be reflected in a direction that faces the optical axis N1 of the lens 3, and may be refracted by the rear surface 32 of the lens 3.

The light F refracted by the rear surface 32 of the lens 3 may pass between the rear surface 32 of the lens 3 and the reflective fluorescent body 4 and may be input to the reflective fluorescent body 4.

The wavelength of the light input to the reflective fluorescent body 4 may be changed by the reflective fluorescent body 4, and the white light F is irradiated from the reflective fluorescent body 4 to the rear surface 32 of the lens 3.

The light irradiated from the reflective fluorescent body 4 to the rear surface 32 of the lens 3 may pass through the lens 3, and the light G may be input to the collimator lens 5 through the rear surface 52 of the collimator lens 5 after passing through the front surface 31 of the lens 3.

The light input to the collimator lens 5 may pass through the collimator lens 5, and may be refracted by the front surface 51 of the collimator lens 5 and may be output to the front side of the collimator lens 5 in parallel.

The light H output to the front side of the collimator lens 5 may correspond to parallel rays.

The light H output to the front side of the collimator lens 5 may be input to the focusing lens 6 through the rear surface 62 of the focusing lens 6.

The light I input to the focusing lens 6 may pass through the focusing lens 6, and may be refracted and concentrated by the front surface 61 of the focusing lens 6 and may be output to the front side of the focusing lens 6.

The light J output to the front side of the focusing lens 6 may pass through the image point S and the focus FF. A portion of the light J output to the front side of the focusing lens 6 may be shielded by the cutoff shield 7 arranged at the image point S.

The cutoff shield 7 may face a lower side of the front surface 61 of the focusing lens 6. At the image point S, the light, which passes through a lower side of the optical axis of the focusing lens 6, of the light J output to the front side of the focusing lens 6 may be shield by the cutoff shield 7.

The light K, which is not shielded by the cutoff shield 7, of the light J output to the front side of the focusing lens 6 may be the light that passes through an upper side of the optical axis N2 of the focusing lens 6 at the image point S.

The light K that is not shielded by the cutoff shield 7 may pass through the focus FF, may gather at one point, and may be output to an area below the optical axis N2 of the focusing lens 6.

The light L output to the area below the optical axis N2 of the focusing lens 6 may be input to the projection lens 8 through the rear surface of the projection lens 8.

The light M input to the projection lens 8 may pass through the projection lens 8, may be refracted by the front surface of the projection lens 8, and may be output to the front side of the projection lens 8 in parallel.

The light output to the front side of the projection lens 8 may be a low beam. Further, the light output to the front side of the projection lens 8 may correspond to parallel rays.

Figure 6:
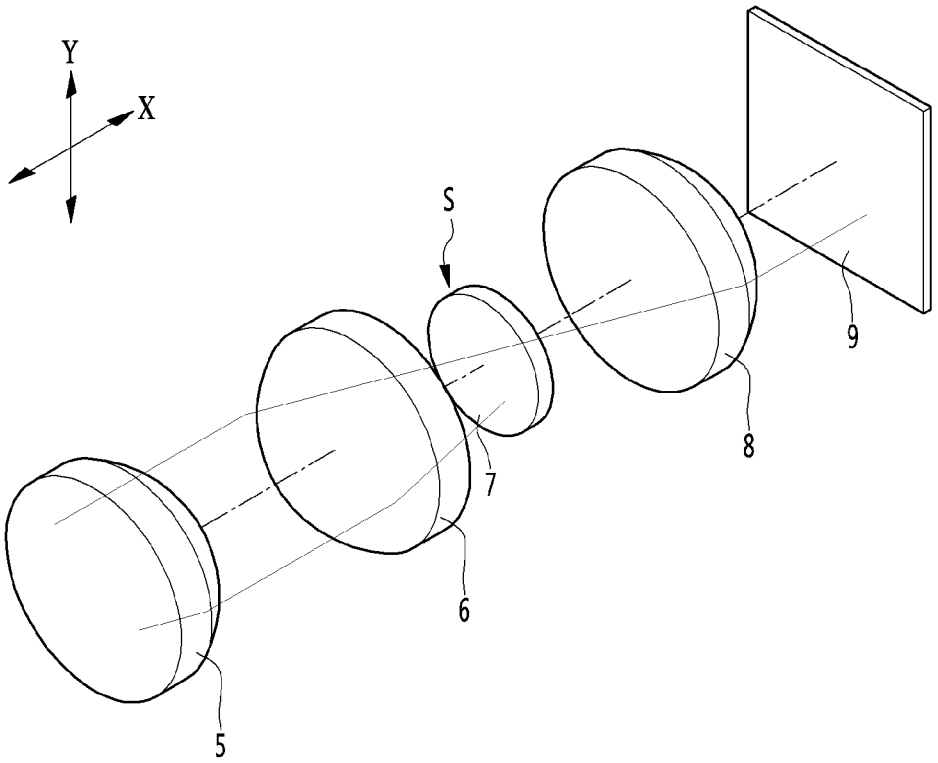
FIG. 6 is a perspective view schematically illustrating a configuration of the light distributing device for a vehicle according to the first embodiment of the present disclosure.
Figure 7A:
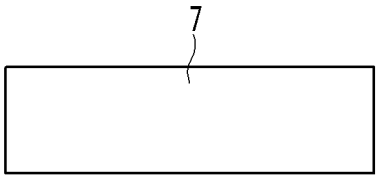
FIGS. 7A and 7B illustrate a plain cutoff shield included in the first embodiment of the present disclosure and an image that is accordingly formed in a screen.
Figure 7B:
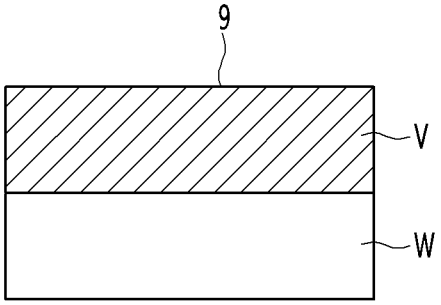
Figure 8A:
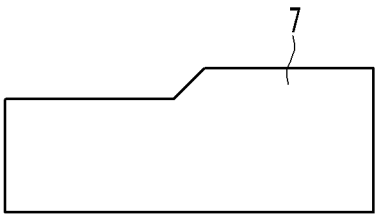
FIGS. 8A and 8B illustrate a cutoff shield included in the first embodiment of the present disclosure and an image that is accordingly formed in a screen.
Figure 8B:
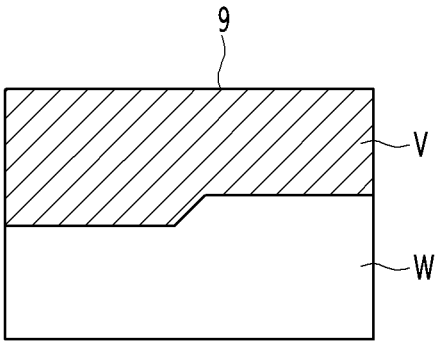

FIG. 6 is a perspective view schematically illustrating a configuration of the light distributing device for a vehicle according to the first embodiment of the present disclosure. FIGS. 7A and 7B illustrate a plain cutoff shield included in the first embodiment of the present disclosure and an image that is accordingly formed in a screen. FIGS. 8A and 8B illustrate a cutoff shield included in the first embodiment of the present disclosure and an image that is accordingly formed in a screen.

FIG. 6 illustrates a collimator lens 5, a focusing lens 6, a cutoff shield 7, a projection lens 8, and a screen 9. Various light distributions may be implemented according to the form of the cutoff shield 7 arranged at an image point S, which may be identified by arranging the screen 9 on the front side of the projection lens 8.

FIG. 7A illustrates a plain cutoff shield 7 having a rectangular shape. FIG. 7B illustrates an image formed on the screen 9 when the cutoff shield 7 of FIG. 7A is arranged in the light distributing unit. If the plain cutoff shield 7 is arranged at the image point S of the focusing lens 6, light distribution characteristics of FIG. 7B may be implemented on the screen 9.

The area, in which light is shielded by the plain cutoff shield 7, is area V of the screen 9 and may appear dark, and the area, in which light is not shielded by the plain cutoff shield 7, is area W of the screen 9 and may appear bright.

FIG. 8A illustrates the cutoff shield 7 that is obtained by removing an area of the cutoff shield 7 having a rectangular shape. FIG. 8B illustrates an image formed in the screen 9 when the cutoff shield 7 of FIG. 8A is arranged in the light distributing unit. If the cutoff shield 7 is arranged at the image point S of the focusing lens 6, light distribution characteristics of FIG. 8B may be implemented on the screen 9.

The area, in which light is shielded by the cutoff shield 7, is area V of the screen 9 and may appear dark, and the area, in which light is not shielded by the cutoff shield 7, is area W of the screen 9 and may appear bright. Further, a cutoff form may be reflected at a border between area V and area W by using the cutoff shield 7.

Accordingly, various forms of light distributions including a low beam may be implemented by selecting the form of the cutoff shield 7 according to the purpose of distribution of light.

Figure 9:
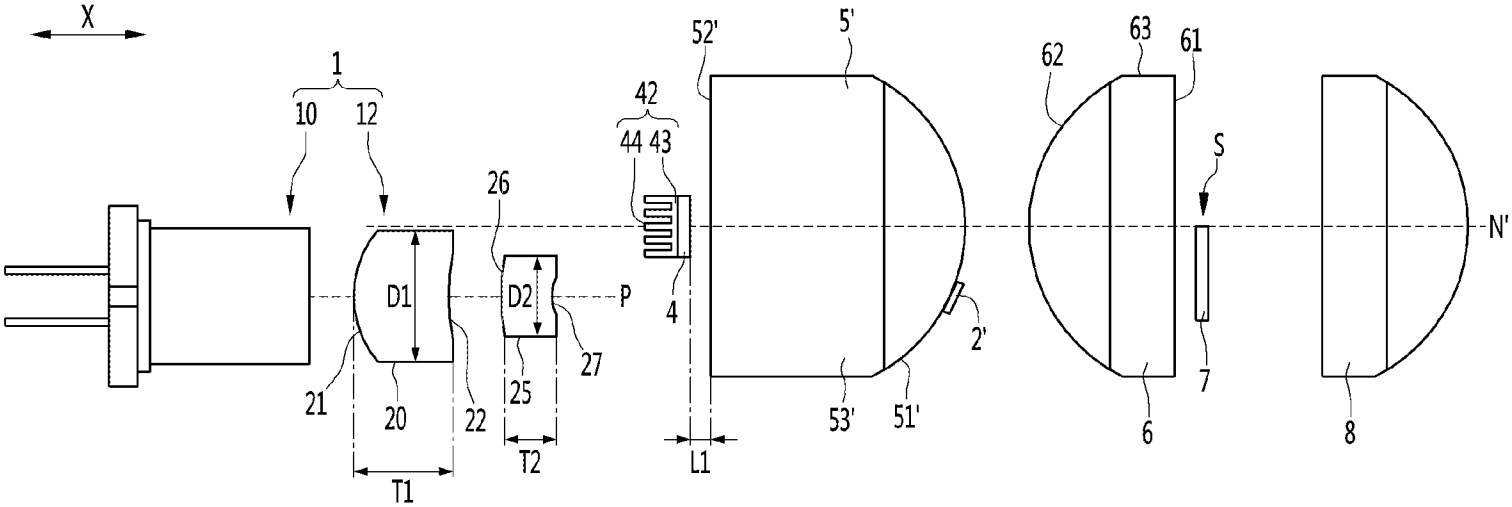
FIG. 9 is a diagram illustrating the light distributing device for a vehicle according to the second embodiment of the present disclosure.
Figure 10:
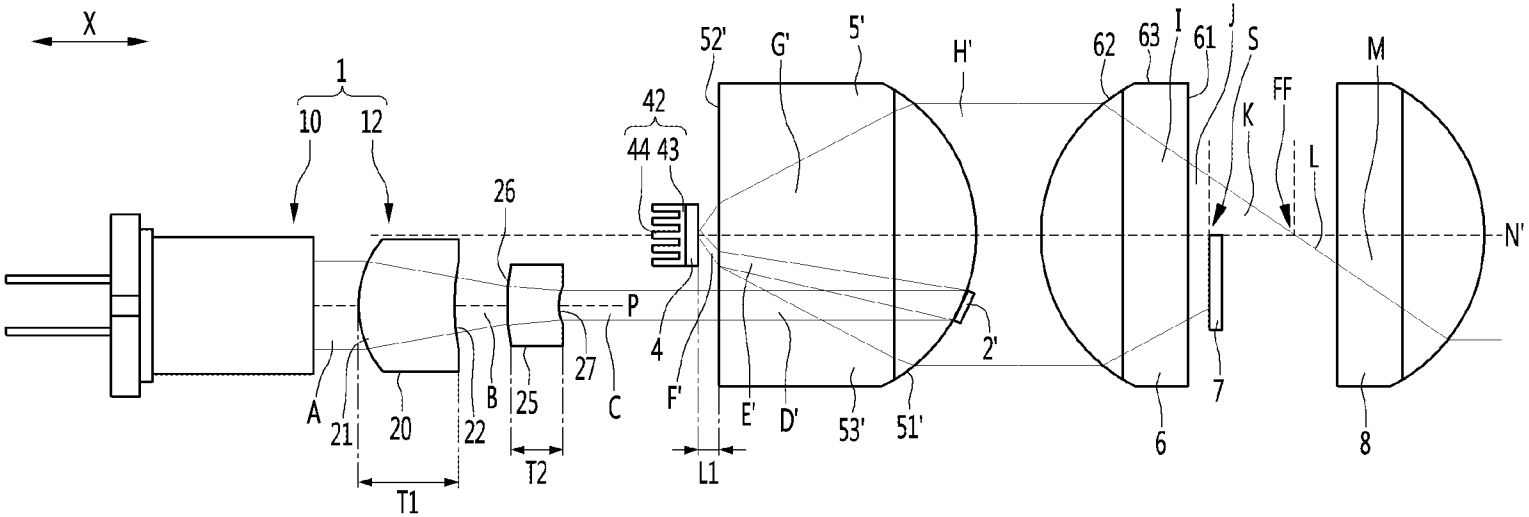
FIG. 10 is a diagram illustrating a light path of the light distributing device for a vehicle according to the second embodiment of the present disclosure.

FIG. 9 is a diagram illustrating the light distributing device for a vehicle according to the second embodiment of the present disclosure. FIG. 10 is a diagram illustrating a light path of the light distributing device for a vehicle according to the second embodiment of the present disclosure.

Hereinafter, configurations and operations that are different from those of the above-mentioned embodiment will be described, and a description of the configurations that are the same as or similar to those of the above-mentioned embodiment will be omitted to avoid repeated descriptions.

The light distributing device according to the first embodiment may include the lens 3 having a reflector and the collimator lens 5 as separate configurations. Meanwhile, the light distributing device according to the second embodiment may implement the functions of the lens 3 and the collimator lens 5 of the first embodiment with one lens.

The collimator lens 5' according to the second embodiment may be thicker than the collimator lens 5 according to the first embodiment. Further, the width of a circumferential surface 53' of the collimator lens 5' according to the second embodiment may be larger than the width of a circumferential surface 53 of the collimator lens 5 according to the first embodiment.

The collimator lens 5' according to the second embodiment may include a reflector 2' on a front surface 51' thereof. Accordingly, the collimator lens 5' according to the second embodiment may function to reflect the light input through the rear surface 52' thereof to a reflective fluorescent body 4. Further, the collimator lens 5' according to the second embodiment may output the light from the reflective fluorescent body 4 and input the light to the rear surface 52' of the collimator lens 5' as parallel rays.

Hereinafter, an operation of the light distributing device according to the second embodiment will be described mainly with reference to a difference from that an operation of the first embodiment.

The width of the light A output by the light source is reduced while the light A sequentially passes through the first reducer lens 20, air between the first reducer lens and the second reducer lens, and the second reducer lens 25, and the light C, of which the width was reduced, may be input to the rear surface 52' of the collimator lens 5' in parallel.

The light D' input to the rear surface 52' of the collimator lens 5' may pass through a rear area of the reflector 2' of the collimator lens 5' and may be input to the rear surface of the reflector 2', and may be reflected from the rear surface of the reflector 2' to the collimator lens 5'.

The light E' reflected by the reflector 2' may be reflected in a direction that faces the optical axis N' of the collimator lens 5', and may be refracted by the rear surface 52' of the collimator lens 5'.

The light F' refracted by the rear surface 52' of the collimator lens 5' may pass between the rear surface 52' of the collimator lens 5' and the reflective fluorescent body 4 and may be input to the reflective fluorescent body 4.

The wavelength of the light input to the reflective fluorescent body 4 may be changed by the reflective fluorescent body 4, and the white light F' is irradiated from the reflective fluorescent body 4 to the rear surface 52' of the collimator lens 5'.

The light irradiated from the reflective fluorescent body 4 to the rear surface 52' of the collimator lens 5' may pass through the collimator lens 5', and the light G' may be refracted by the front surface 51 of the collimator lens 5' and may be output to the front side of the collimator lens 5' in parallel.

The light H' output to the front side of the collimator lens 5' may correspond to parallel rays.

The light H' output to the front side of the collimator lens 5' may be input to the focusing lens 6 through the rear surface 62 of the focusing lens 6.

Hereinafter, configurations and operations that are different from those of the above-mentioned embodiment will be described, and a description of the configurations that are the same as or similar to those of the above-mentioned embodiment will be omitted to avoid repeated descriptions.

Figure 11:
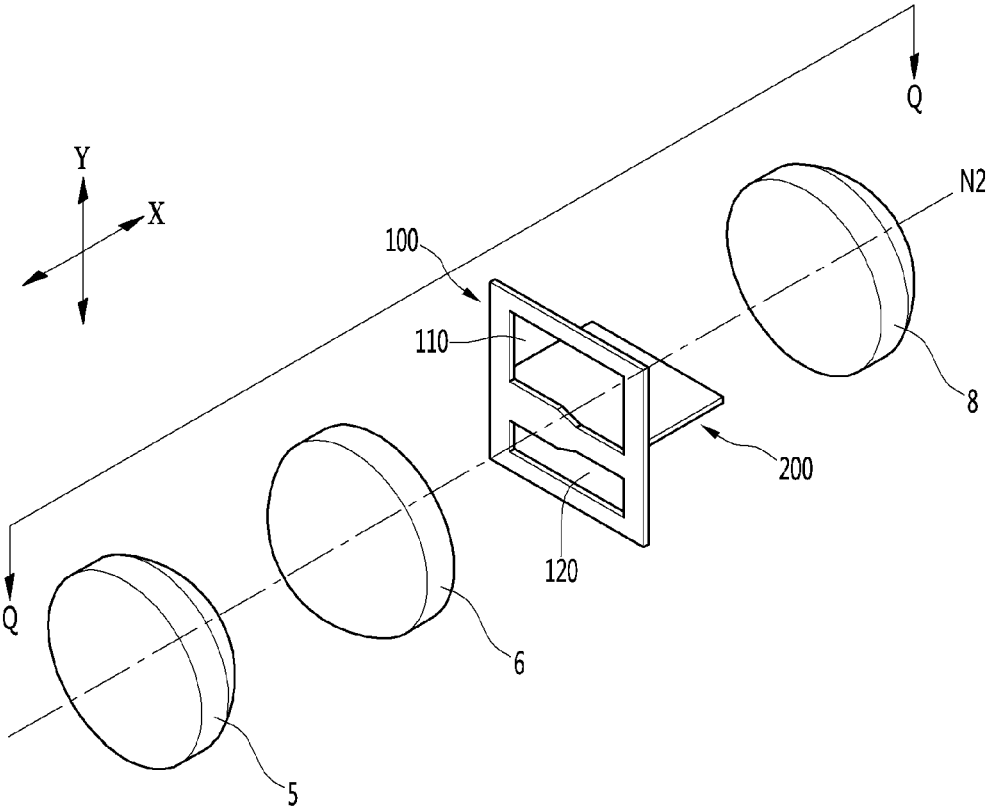
FIG. 11 is a perspective view illustrating the light distributing device for a vehicle according to the third embodiment of the present disclosure.
Figure 12:
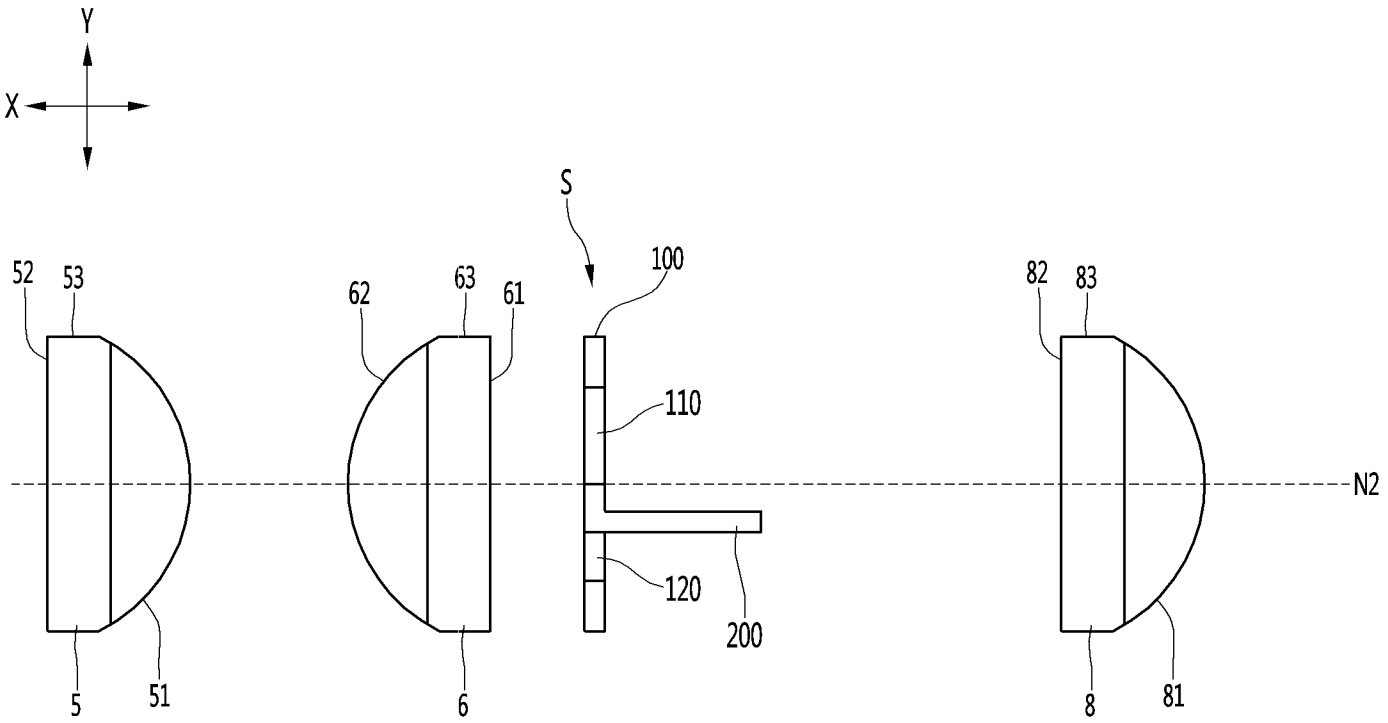
FIG. 12 is a sectional view taken along line Q-Q of FIG. 11.
Figure 13:
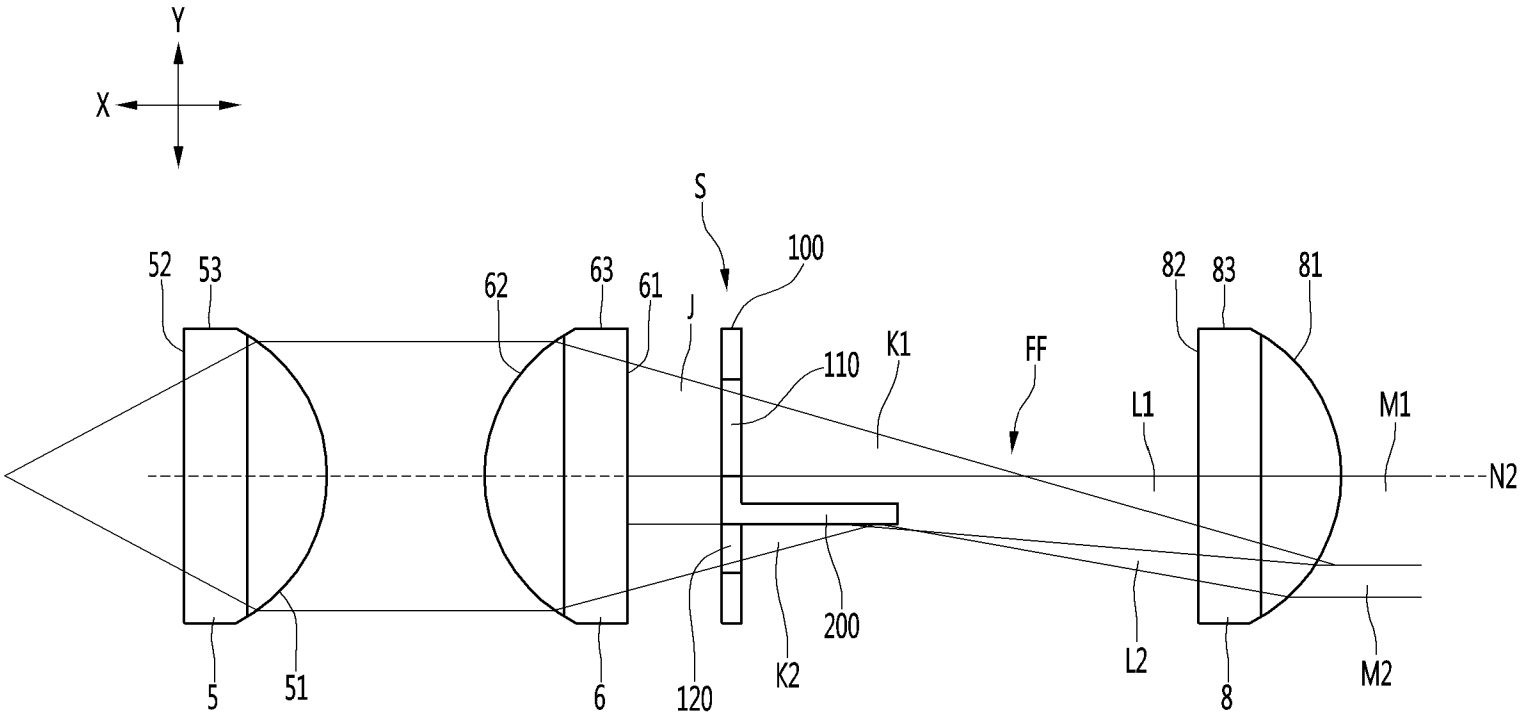
FIG. 13 is a sectional view illustrating an optical path that is added to the sectional view of FIG. 12.

FIG. 11 is a perspective view illustrating the light distributing device for a vehicle according to the third embodiment of the present disclosure. FIG. 12 is a sectional view taken along line Q-Q of FIG. 11. FIG. 13 is a sectional view illustrating an optical path that is added to the sectional view of FIG. 12.

Referring to FIGS. 11 to 13, the light distributing device according to the third embodiment may include a focusing lens 6, a shield 100, and a mirror 200.

The focusing lens 6 may concentrate the light input to the rear surface 62 to form an image point S on the front side thereof.

The shield 100 may be arranged at an image point formed by the focusing lens 6, and an opening, through which a portion of the light passing through the image point passes, may be formed in the shield 100.

The mirror 200 may reflect at least a portion of the light that passed through the opening to the front side of the focusing lens 6.

The front surface 61 of the focusing lens 6 may be a flat surface or a curved surface that is concave towards the rear side. Further, a portion of the front surface 61 of the focusing lens 6 may be a flat surface, and the remaining portions of the front surface 61 may be a curved surface that is concave towards the rear side.

The shield 100 may face the front surface 61 of the focusing lens 6.

When the front surface 61 of the focusing lens 6 is a flat surface, the shield 100 may be parallel to the front surface 61 of the focusing lens 6.

A plurality of openings may be formed in the shield 100. The shield 100 may include an upper opening 110 that is formed above the optical axis of the focusing lens 6. Further, the shield 100 may include a lower opening 110 that is formed below the optical axis of the focusing lens 6.

The focusing lens 6, the shield 100, and the mirror 200 may be arranged in the sequence of the focusing lens 6, the shield 100, and the mirror 200 along a direction in which the light input to the rear surface 62 of the focusing lens 6 is output.

The mirror 200 may be parallel to the optical axis of the focusing lens 6.

When the front surface 61 of the focusing lens 6 is a flat surface, the mirror 200 may be perpendicular to the front surface 61 of the focusing lens 6.

The mirror 200 may include a reflective surface that reflects the light that passes through an image point formed by the focusing lens 6.

The mirror 200 may reflect the light that passed through the lower opening 120 of the shield 100.

The reflective surface of the mirror 200 may be spaced apart from the optical axis of the focusing lens 6 by a predetermined distance.

The light distributing device according to the third embodiment may further include a collimator lens 5 that is arranged on the rear side of the focusing lens 6 to output the light input to a rear surface 52 thereof as parallel rays.

The rear surface 52 of the collimator lens 5 may be a flat surface or a curved surface that is concave towards the front side. Further, a portion of the rear surface 52 of the collimator lens 5 may be a flat surface, and the remaining portions of the rear surface 52 may be a curved surface that is concave towards the front side.

The collimator lens 5 may be arranged such that the front surface 51 of the collimator lens 5 faces the rear surface of the focusing lens 6.

The front surface 61 of the focusing lens 6 may be a flat surface, and the rear surface 52 of the collimator lens 5 may be a flat surface. Further, the front surface 61 of the focusing lens 6 and the rear surface 52 of the collimator lens 5 may be parallel to each other.

The light distributing device according to the third embodiment may further include a projection lens 8 that is arranged on the front side of the focusing lens 6.

The rear surface 82 of the projection lens 8 may be a flat surface or a curved surface that is concave towards the front side. Further, a portion of the rear surface 82 of the projection lens 8 may be a flat surface, and the remaining portions of the rear surface 82 may be a curved surface that is concave towards the front side.

The optical axis of the focusing lens 6, the optical axis of the projection lens 8, and the optical axis of the collimator lens 5 may coincide with each other.

The front surface 61 of the focusing lens 6 may be a flat surface, and the rear surface 82 of the projection lens 8 may be a flat surface. Further, the front surface 61 of the focusing lens 6 and the rear surface 82 of the projection lens 8 may be parallel to each other.

The shield 100 may face the rear surface 82 of the projection lens 8.

When the rear surface 82 of the projection lens 8 is a flat surface, the shield 100 may be parallel to the rear surface 82 of the projection lens 8.

The mirror 200 may be parallel to the optical axis of the collimator lens 5.

When the rear surface 52 of the collimator lens 5 is a flat surface, the mirror 200 may be perpendicular to the rear surface 52 of the collimator lens 5.

The reflective surface of the mirror 200 may be spaced apart from the optical axis of the collimator lens 5 by a predetermined distance.

The mirror 200 may be parallel to the optical axis of the projection lens 8.

When the rear surface 82 of the projection lens 8 is a flat surface, the mirror 200 may be perpendicular to the rear surface 82 of the projection lens 8.

The reflective surface of the mirror 200 may be spaced apart from the optical axis of the projection lens 8 by a predetermined distance.

The mirror 200 may reflect the light that passed through the lower opening 120 of the shield 100, and the light reflected by the mirror 200 may be input to the rear surface 82 of the projection lens 8. Further, the light reflected by the mirror 200 may be input to an area below the optical axis of the projection lens 8.

The light that passed through the upper opening 110 of the shield 100 may be input to an area below the optical axis of the projection lens 8.

The light input to a lower side of the optical axis of the projection lens 8 may be output as a low beam.

The brightness of the low beam may correspond to a brightness that is obtained by adding the brightness due to the light that passed through the upper opening 110 of the shield 100 and the brightness due to the light reflected by the mirror 200.

The focusing lens 6 may form a focus on the front side thereof. The focus formed by the focusing lens 6 may be situated between the projection lens 8 and the focusing lens 6.

When the focus formed by the focusing lens 6 is situated on the front side of the rear surface 82 of the projection lens 8, the light that passed through the upper opening 110 of the shield 100 may be input to an upper side of the optical axis of the projection lens 8. Further, the light that is input to the upper side of the optical axis of the projection lens 8 may be output to the upper side of the optical axis of the projection lens 8. When the light is output to the upper side of the optical axis of the projection lens 8, a low beam may not be implemented.

Accordingly, it is preferable that the projection lens 8 be arranged such that the focus formed by the focusing lens 6 is situated between the focusing lens 6 and the projection lens 8 to implement a low beam.

The focusing lens 6, the shield 100, the mirror 200, and the projection lens 8 may be arranged in the sequence of the focusing lens 6, the shield 100, the mirror 200, and the projection lens 8 along a direction in which the light input to the rear surface 62 of the focusing lens 6 is output.

Hereinafter, an operation of the present disclosure will be described. Hereinafter, it will be exemplified that the light output from the light source is input to the rear side of the collimator lens 5.

The light input to the collimator lens 5 may pass through the collimator lens 5, and may be refracted by the front surface 51 of the collimator lens 5 and may be output to the front side of the collimator lens 5 in parallel.

The light H output to the front side of the collimator lens 5 may correspond to parallel rays.

The light H output to the front side of the collimator lens 5 may be input to the focusing lens 6 through the rear surface 62 of the focusing lens 6.

The light I input to the focusing lens 6 may pass through the focusing lens 6, and may be refracted and concentrated by the front surface 61 of the focusing lens 6 and may be output to the front side of the focusing lens 6.

The light J output to the front side of the focusing lens 6 may pass through the image point S and the focus FF. A portion of the light J output to the front side of the focusing lens 6 may be shielded by the shield 100 arranged at the image point S.

A portion of the light J output to the front side of the focusing lens 6 may be light K1 that passes through the upper opening 110 formed in the shield 100.

A portion of the light J output to the front side of the focusing lens 6 may be light K2 that passes through the lower opening 120 formed in the shield 100.

The light K1 that passed through the upper opening 110 may pass through the focus FF, may gather at one point, and may be output to an area below the optical axis N2 of the focusing lens 6.

The light L1 that passed through the upper opening 110 and then passed through the focus FF of the focusing lens 6 may be input to the projection lens 8 through the rear surface 82 of the projection lens 8.

The light input to the projection lens 8 may pass through the projection lens 8, may be refracted by the front surface

81 of the projection lens 8, and may be output to the front side of the projection lens 8 in parallel.

The light M1 output to the front side of the projection lens 8 may be a low beam. Further, the light M1 output to the front side of the projection lens 8 may correspond to parallel rays.

The light K2 that passed through the lower opening 120 may be input to the mirror 200. The mirror 200 may reflect the light K2 that passed through the lower opening 120 towards the projection lens 8.

The light L2 reflected by the mirror 200 may be input to the projection lens 8 without passing through the focus FF of the focusing lens 6.

The light input to the projection lens 8 may pass through the projection lens 8, may be refracted by the front surface 81 of the projection lens 8, and may be output to the front side of the projection lens 8 in parallel.

The light M2 output to the front side of the projection lens 8 may be a low beam. Further, the light M2 output to the front side of the projection lens 8 may correspond to parallel rays.

The light M1 that passes through the upper opening 110 of the shield 100 and is output to the front side of the projection lens 8 and the light M2 that passes through the lower opening 120 of the shield 100 and is output to the front side of the projection lens 8 may overlap each other, and accordingly, the amount of light that is output through the projection lens 8 may increase.

Figure 14:
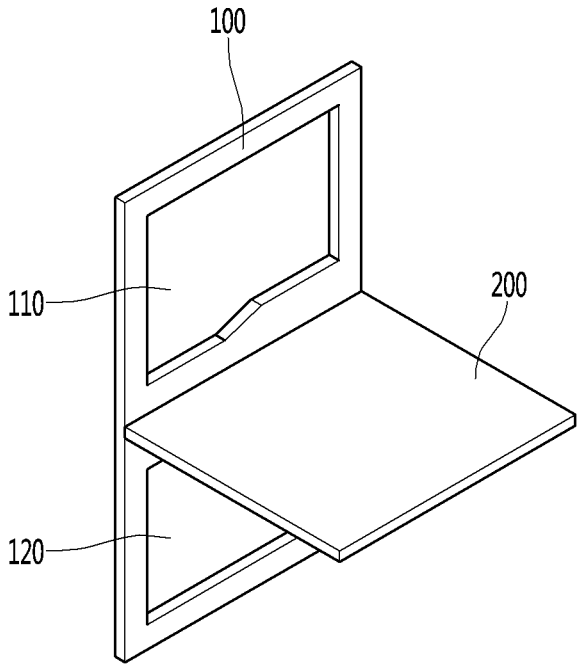
FIG. 14 is a perspective view illustrating a shield and a mirror included in the light distributing device for a vehicle according to the third embodiment of the present disclosure.
Figure 15:
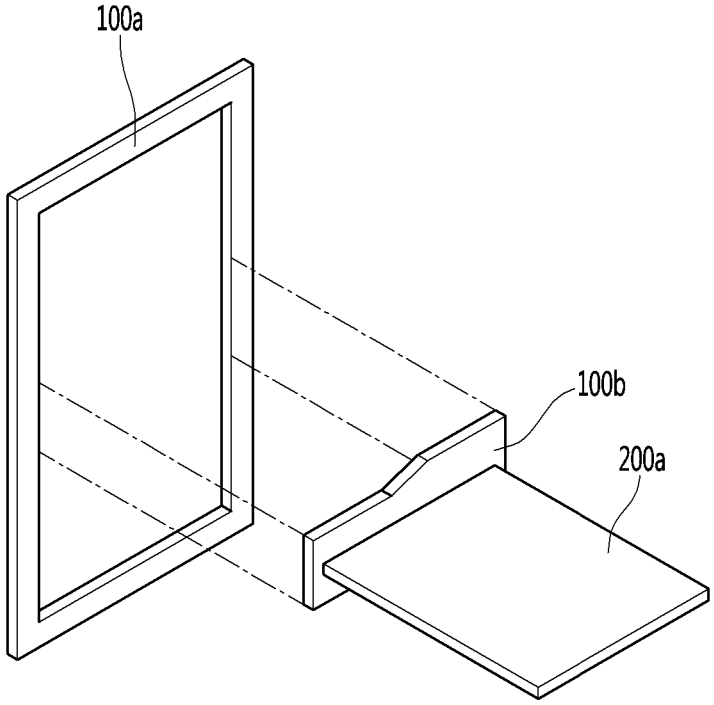
FIG. 15 is a perspective view illustrating a shield and a mirror included in the light distributing device for a vehicle according to the fourth embodiment of the present disclosure.
Figure 16:
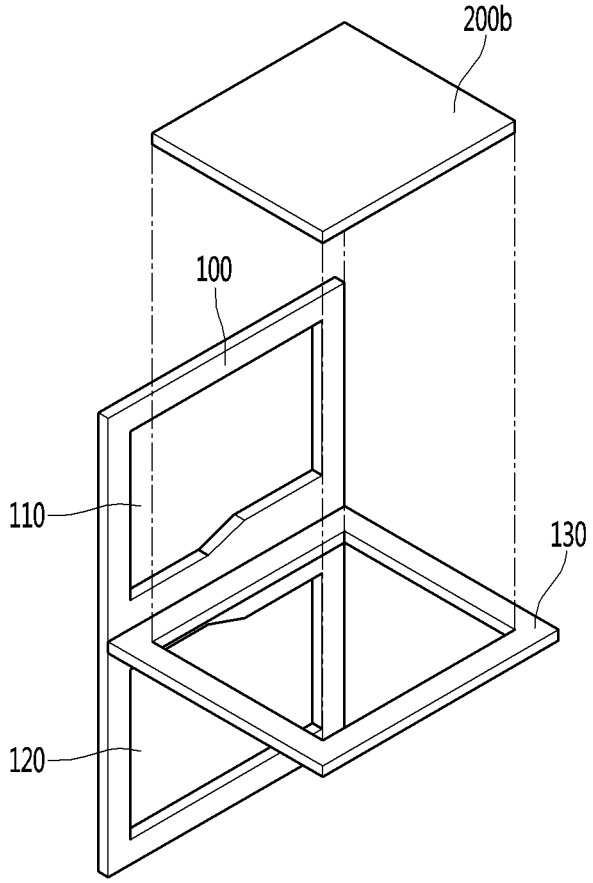
FIG. 16 is a perspective view illustrating a shield and a mirror included in the light distributing device for a vehicle according to the fifth embodiment of the present disclosure.

FIG. 14 is a perspective view illustrating a shield 100 and a mirror 200 included in a light distributing device for a vehicle according to a third embodiment of the present disclosure. FIG. 15 is a perspective view illustrating a shield 100 and a mirror 200 included in a light distributing device for a vehicle according to a fourth embodiment of the present disclosure. FIG. 16 is a perspective view illustrating a shield 100 and a mirror 200 included in a light distributing device for a vehicle according to a fifth embodiment of the present disclosure.

According to the third embodiment of the present disclosure, the mirror 200 and the shield 100 may constitute one assembly.

The mirror 200 and the shield 100 may integrally constitute an assembly. Further, one side of the mirror 200 may be attached to the shield 100 to constitute one assembly.

The mirror 200 and the shield 100 may be perpendicular to each other. Further, a reflective surface of the mirror 200 and the shield 100 may be perpendicular to each other.

The shield 100 may include an upper opening 110 and a lower opening 120, and a part at which the shield 100 and the mirror 200 is connected to each other may be situated between the upper opening 110 and the lower opening 120.

Further, the mirror 200 and the shield 100 may be arranged as separate configurations to be spaced apart from each other. When the mirror 200 and the shield 100 are spaced apart from each other, the light distributing device may further include a fixing unit for fixing the mirror 200.

According to the fourth embodiment of the present disclosure, the shield 100 may include a main shield 100*a* having an opening and a mirror shield 100*b* which blocks a portion of the opening and on which a mirror 200 is mounted.

The main shield 100*a* may have one opening.

The mirror shield 100*b* may be coupled to the main shield 100*a*. If the main shield 100*a* and the mirror shield 100*b* are coupled to each other, the opening of the main shield 100*a* may be divided into an upper opening 110 and a lower opening 120 by the mirror shield 100*b*.

The mirror 200*a* may be mounted on the mirror shield 100*b*. Further, the mirror 200*a* and the mirror shield 100*b* may be integrally formed. One side of the mirror 200*a* may be attached to the mirror shield 100*b*.

According to the fifth embodiment of the present disclosure, a mirror seating part 130 may protrude from the shield 100 and the mirror 200*b* may be seated on the mirror seating part 130.

The shield 100 may include an upper opening 110 and a lower opening 120, and a part of the shield 100, from which the mirror seating part 130 protrudes, may be situated between the upper opening 110 and the lower opening 120.

The mirror seating part 130 may include an opening. The mirror 200*b* may be seated on the mirror seating part 130.

Further, the mirror 200*b* may be seated on the opening of the mirror seating part 130.

If the mirror 200*b* is seated on the mirror seating part 130, a reflective surface of the mirror 200*b* may be exposed to the outside of the mirror seating part 130. The reflective surface of the mirror 200*b*, which is exposed to the outside of the mirror seating part 130, may reflect the light that passed through the lower opening 120 of the shield 100.

Figure 17A:
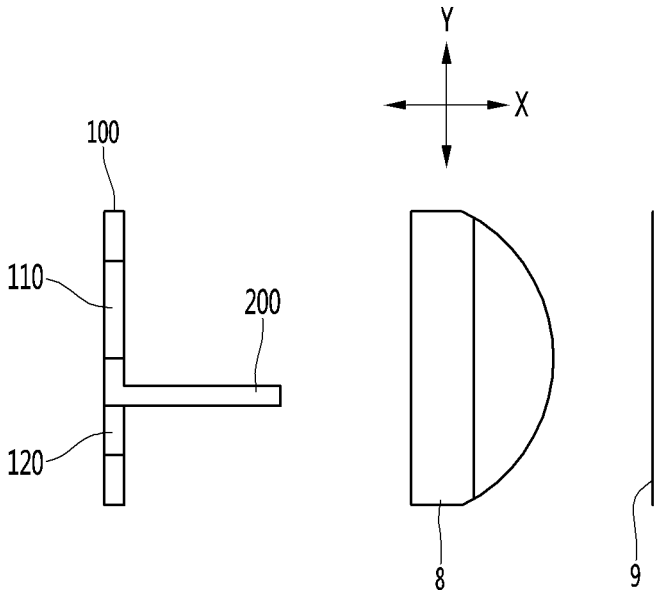
FIGS. 17A and 17B are exemplary views illustrating light distributions implemented by the light distributing device for a vehicle according to the third embodiment of the present disclosure.
Figure 17B:
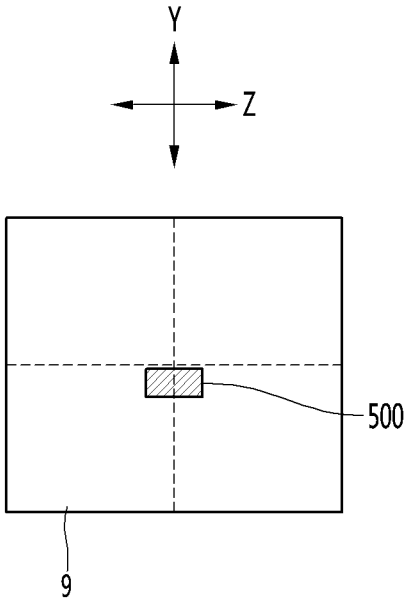
Figure 18A:
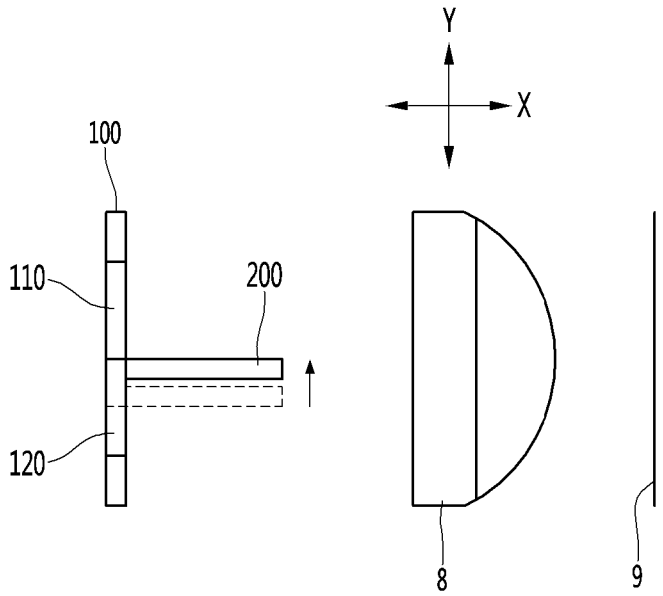
FIGS. 18A and 18B are exemplary views illustrating light distributions implemented by the light distributing device for a vehicle according to the sixth embodiment of the present disclosure.
Figure 18B:
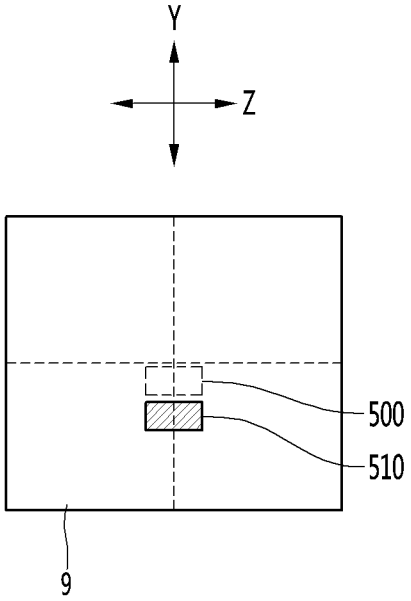
Figure 19A:
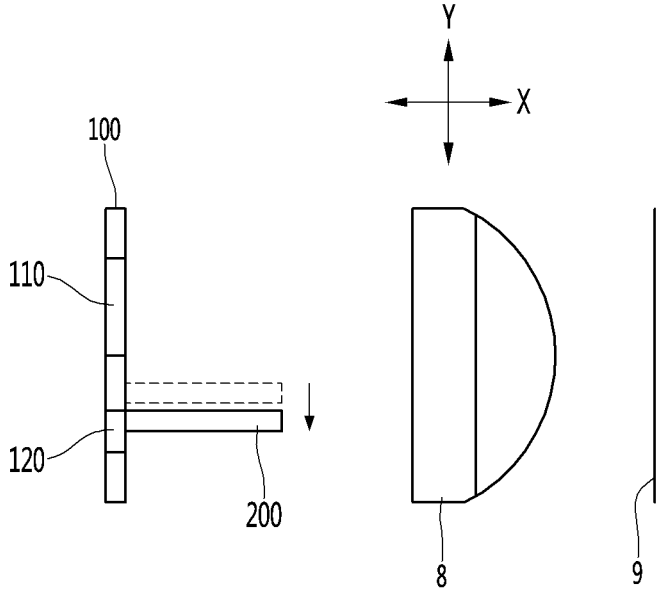
FIGS. 19A and 19B are other exemplary views illustrating light distributions implemented by the light distributing device for a vehicle according to the sixth embodiment of the present disclosure.
Figure 19B:
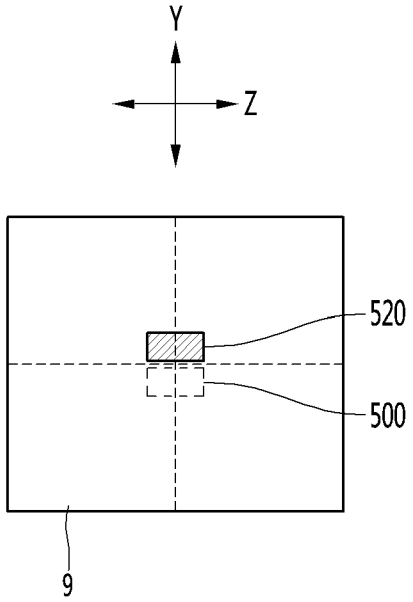
Figure 20A:
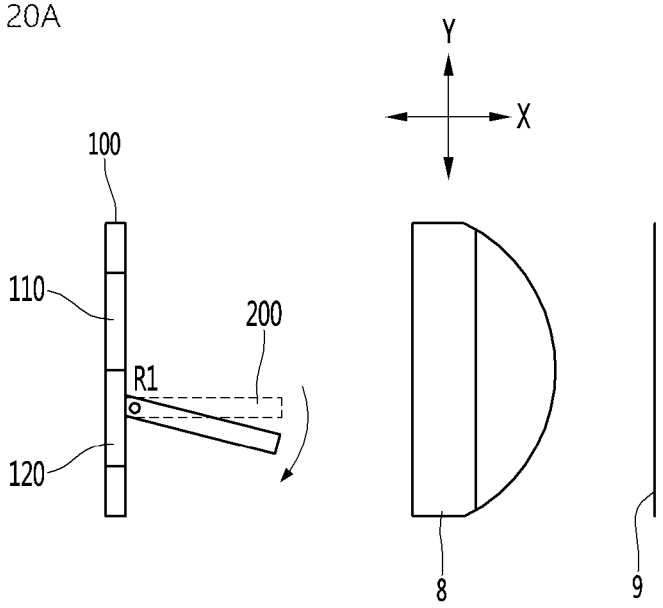
FIGS. 20A and 20B are exemplary views illustrating light distributions implemented by the light distributing device for a vehicle according to the seventh embodiment of the present disclosure.
Figure 20B:
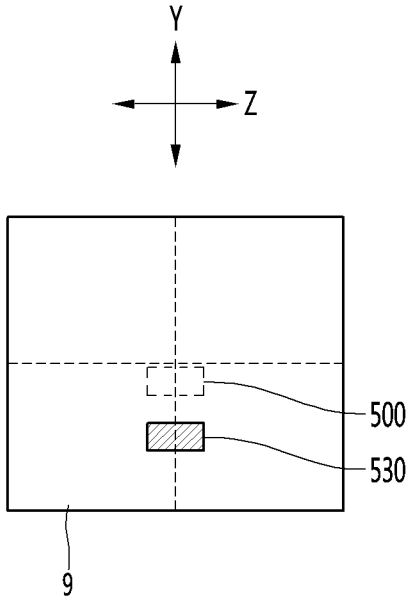
Figure 21A:
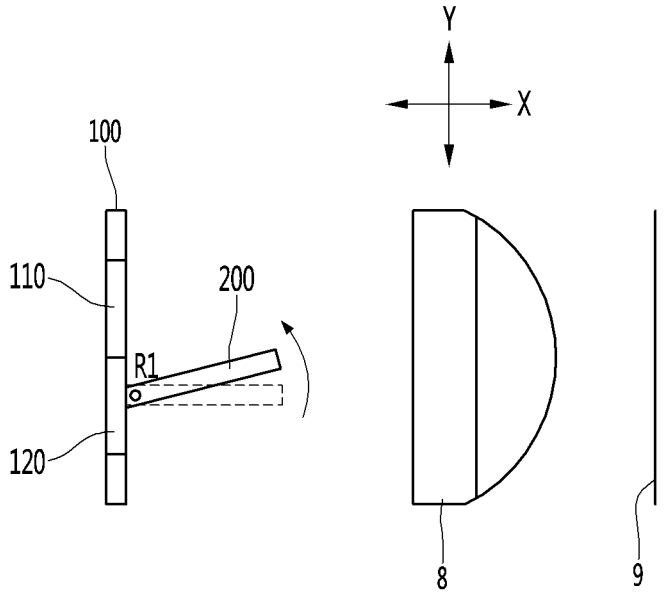
FIGS. 21A and 21B are other exemplary views illustrating light distributions implemented by the light distributing device for a vehicle according to the seventh embodiment of the present disclosure.
Figure 21B:
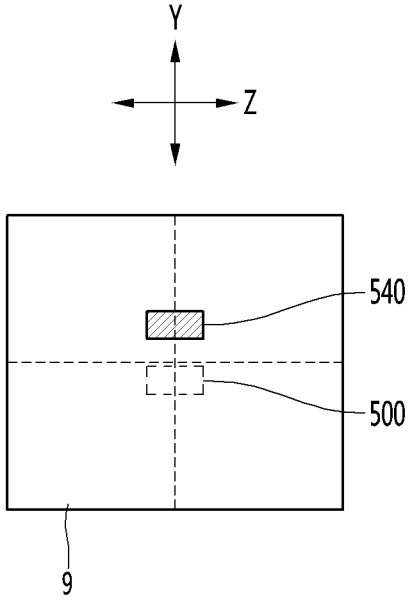
Figure 22A:
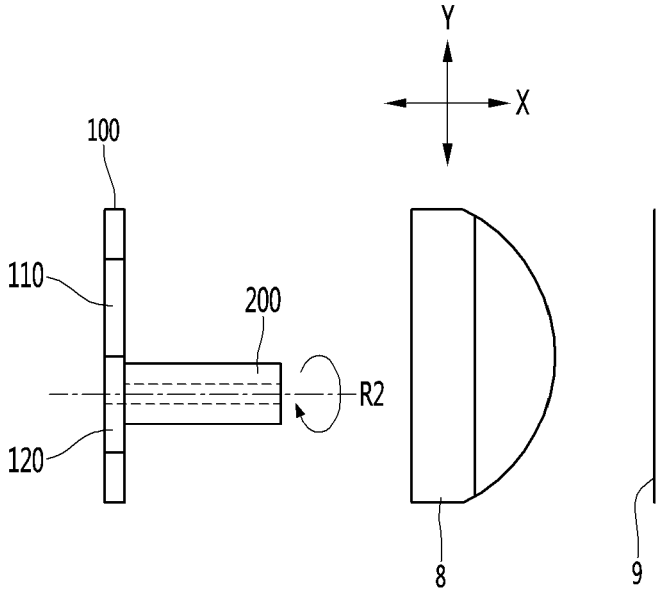
FIGS. 22A and 22B are exemplary views illustrating light distributions implemented by the light distributing device for a vehicle according to the eighth embodiment of the present disclosure.
Figure 22B:
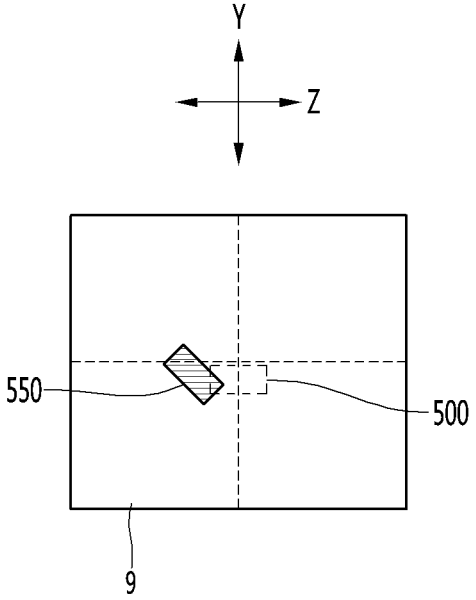
Figure 23A:
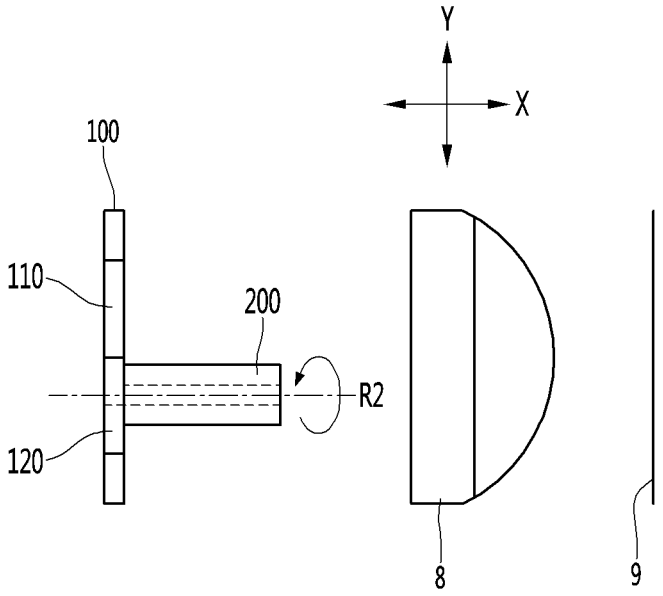
FIGS. 23A and 23B are other exemplary views illustrating light distributions implemented by the light distributing device for a vehicle according to the eighth embodiment of the present disclosure.
Figure 23B:
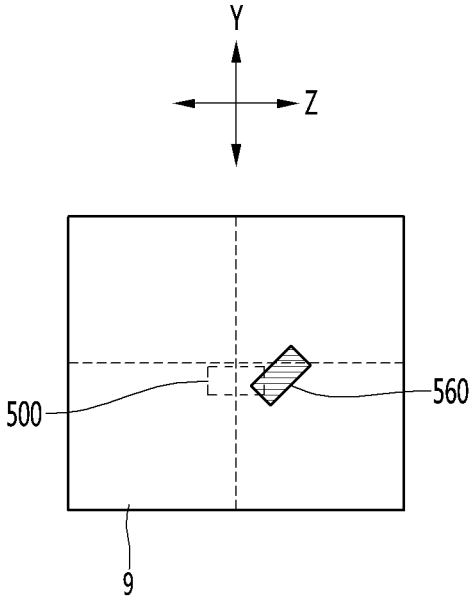

FIGS. 17A and 17B are exemplary views illustrating light distributions implemented by the light distributing device for a vehicle according to the third embodiment of the present disclosure. FIGS. 18A and 18B are exemplary views illustrating light distributions implemented by the light distributing device for a vehicle according to the sixth embodiment of the present disclosure. FIGS. 19A and 19B are other exemplary views illustrating light distributions implemented by the light distributing device for a vehicle according to the sixth embodiment of the present disclosure. FIGS. 20A and 20B are exemplary views illustrating light distributions implemented by the light distributing device for a vehicle according to the seventh embodiment of the present disclosure. FIGS. 21A and 21B are other exemplary views illustrating light distributions implemented by the light distributing device for a vehicle according to the seventh embodiment of the present disclosure. FIGS. 22A and 22B are exemplary views illustrating light distributions implemented by the light distributing device for a vehicle according to the eighth embodiment of the present disclosure. FIGS. 23A and 23B are other exemplary views illustrating light distributions implemented by the light distributing device for a vehicle according to the eighth embodiment of the present disclosure.

If a screen 9 is arranged on the front side of the projection lens 8, the forms of the light distributions that are implemented by the light distributing device for a vehicle according to the embodiments of the present disclosure may be identified.

FIG. 17A illustrates a shield 100, a mirror 200, and a projection lens 8 of a light distributing device for a vehicle according to the third embodiment of the present disclosure. FIG. 17B illustrates a light distribution 500 that is implemented when a screen 9 is arranged on the front side of the projection lens 8 of the light distributing device for a vehicle according to the third embodiment of the present disclosure.

The light distributing device for a vehicle according to the sixth embodiment of the present disclosure may further include a mirror elevating device (not illustrated) that elevates the mirror 200. The mirror elevating device may lift or lower the mirror 200.

FIG. 18A illustrates the shield 100, the mirror 200, and the projection lens 8, and illustrates that the mirror elevating device lifts the mirror 200. FIG. 18B illustrates a light distribution 510 that is implemented when the screen 9 is arranged on the front side of the projection lens 8 and the mirror 200 is lifted by the mirror elevating device.

When the light distribution 500 implemented when the mirror 200 is not lifted and the light distribution 510 implemented when the mirror 200 is lifted are compared, the light distribution 510 implemented when the mirror elevating device lifts the mirror 200 is moved in parallel to a lower side (−Y axis direction) of the light distribution 500 implemented when the mirror 200 is not lifted.

FIG. 19A illustrates the shield 100, the mirror 200, and the projection lens 8, and illustrates that the mirror elevating device lowers the mirror 200. FIG. 19B illustrates a light distribution 520 that is implemented when the screen 9 is arranged on the front side of the projection lens 8 and the mirror 200 is lowered by the mirror elevating device.

When the light distribution 500 implemented when the mirror 200 is not lowered and the light distribution 520 implemented when the mirror 200 is lowered are compared, the light distribution 520 implemented when the mirror elevating device lowers the mirror 200 may be moved in parallel to an upper side (+Y axis direction) of the light distribution 500 implemented when the mirror 200 is not lifted.

The light distributing device for a vehicle according to the seventh embodiment of the present disclosure may further include a mirror rotating device (not illustrated) that rotates the mirror 200 about a rotational axis R1.

The rotational axis R1 of the mirror rotating device may be parallel to the shield 100.

FIG. 20A illustrates a shield 100, a mirror 200, and a projection lens 8, and illustrates that the mirror rotating device rotates the mirror 200 such that an angle between a reflective surface of the mirror 200 and a lower opening 120 of the shield 100 becomes smaller. FIG. 20B illustrates that the screen 9 is arranged on the front side of the projection lens 8, and illustrates a light distribution 530 that is implemented by FIG. 20A.

When the light distribution 500 implemented when the mirror 200 is not rotated and the light distribution 530 implemented when the mirror is rotated are compared, the light distribution 530 implemented when the mirror 200 is rotated such that the angle between the reflective surface of the mirror 200 and the lower opening 120 of the shield 100 becomes smaller may be moved in parallel to a lower side (−Y axis direction) of the distribution 500 implemented when the mirror 200 is not rotated.

FIG. 21A illustrates a shield 100, a mirror 200, and a projection lens 8, and illustrates that the mirror rotating device rotates the mirror 200 such that an angle between a reflective surface of the mirror 200 and a lower opening 120 of the shield 100 becomes larger. FIG. 21B illustrates that the screen 9 is arranged on the front side of the projection lens 8, and illustrates a light distribution 540 that is implemented by FIG. 21A.

If the light distribution 500 implemented when the mirror 200 is not rotated and the light distribution 540 implemented when the mirror 200 is rotated are compared, the light distribution 540 implemented when the mirror 200 is rotated such that an angle between the reflective surface of the mirror 200 and the lower opening 120 become larger may be moved in parallel to an upper side (+Y axis direction) of the light distribution 500 implemented when the mirror 200 is not rotated.

The light distributing device for a vehicle according to the eighth embodiment of the present disclosure may further include a mirror rotating device (not illustrated) that rotates the mirror 200 about a rotational axis R2.

The rotational axis R2 of the mirror rotating device may be parallel to the optical axis of the focusing lens.

FIG. 22A illustrates the shield 100, the mirror 200, and the projection lens 8, and illustrates that the mirror moving device rotates the mirror 200 clockwise when the shield 100 is viewed from a location of the projection lens 8. FIG. 22B illustrates that the screen 9 is arranged on the front side of the projection lens 8, and illustrates a light distribution 550 that is implemented by FIG. 22A.

When being compared with the light distribution 500 implemented when the mirror 200 is not rotated, the light distribution 550 implemented when the mirror rotating device rotates the mirror 200 clockwise may be rotated to the left side (−Z axis direction) of the light distribution 500 implemented when the mirror 200 is not rotated.

FIG. 23A illustrates the shield 100, the mirror 200, and the projection lens 8, and illustrates that the mirror moving device rotates the mirror 200 counterclockwise when the shield 100 is viewed from a location of the projection lens 8. FIG. 23B illustrates that the screen 9 is arranged on the front side of the projection lens 8, and illustrates a light distribution 560 that is implemented by FIG. 23A.

When being compared with the light distribution 500 implemented when the mirror 200 is not rotated, the light distribution 560 implemented when the mirror rotating device rotates the mirror 200 counterclockwise may be rotated to the right side (+Z axis direction) of the light distribution 500 implemented when the mirror 200 is not rotated.

Figure 24:
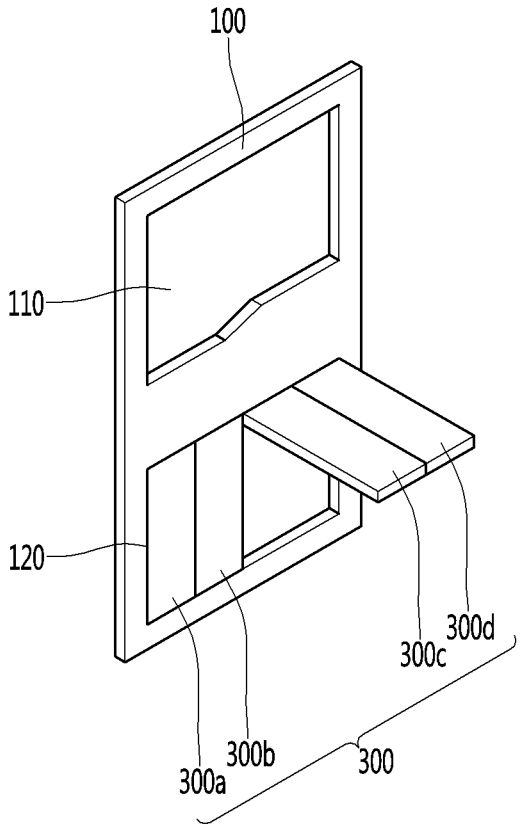
FIG. 24 is a perspective view illustrating a shield and a shutter mirror included in the light distributing device for a vehicle according to the ninth embodiment of the present disclosure.

FIG. 24 is a perspective view illustrating a shield 100 and a shutter mirror 300 included in a light distributing device for a vehicle according to a ninth embodiment of the present disclosure.

The light distributing device for a vehicle according to the ninth embodiment of the present disclosure may further include a shutter mirror 300 and a mirror rotating device (not illustrated).

The shutter mirror 300 may include a plurality of unit mirrors 300*a*, 300*b*, 300*c*, and 300*d*. The mirror rotating device may selectively rotate the plurality of unit mirrors 300*a*, 300*b*, 300*c*, and 300*d*.

The unit mirrors 300*a*, 300*b*, 300*c*, and 300*d* may open and close a portion of the lower opening formed in the shield. When all the unit mirrors 300*a*, 300*b*, 300*c*, and 300*d* of the shutter mirror 300 are opened, the lower opening 120 may be fully opened. When all the unit mirrors 300*a*, 300*b*, 300*c*, and 300*d* of the shutter mirror 300 are closed, the lower opening 120 may be completely closed.

Further, the mirror rotating device may adjust the amount of light that passes through the lower opening 120 by selectively rotating the plurality of unit mirrors 300*a*, 300*b*, 300*c*, and 300*d*.

The number of the unit mirrors included in the shutter mirror 300 may become larger or smaller if necessary.

Figure 25:
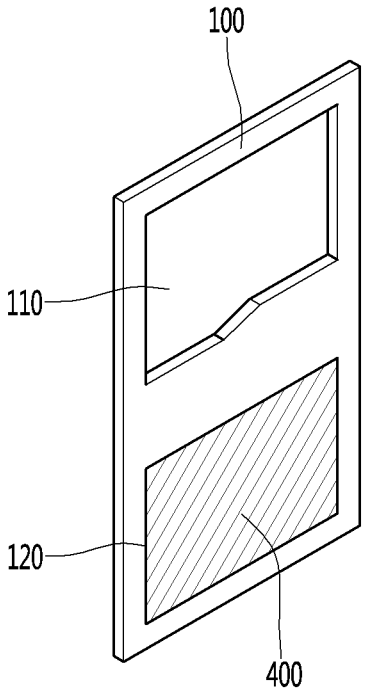
FIG. 25 is a perspective view illustrating a shield and a transparent display included in the light distributing device for a vehicle according to the tenth embodiment of the present disclosure.

FIG. 25 is a perspective view illustrating a shield 100 and a transparent display 400 included in a light distributing device for a vehicle according to a tenth embodiment of the present disclosure.

The transparent display 400 may be arranged in the lower opening 120 formed in the shield 100. The lower opening 120 may be closed by the transparent display 400. The transparent display 400 may transmit light.

The transparent display 400 may display different colors or brightness if necessary. For example, the transparent display 400 may adjust transmittance by displaying a specific color or varying the brightness thereof, and may adjust the amount of light that passes through the transparent display 400.

The light distributing devices for a vehicle according to the first to tenth embodiments of the present disclosure may be included in a vehicle.

According to an embodiment of the present disclosure, the brightness of a low beam can be improved by using a mirror when the low beam is implemented.

In addition, according to an embodiment of the present disclosure, a light distribution in a direction desired by the user can be implemented by elevating or rotating a mirror.

The above description is a simple exemplification of the technical spirit of the present disclosure, and the present disclosure may be variously corrected and modified by those skilled in the art to which the present disclosure pertains without departing from the essential features of the present disclosure.

Therefore, the disclosed embodiments of the present disclosure do not limit the technical spirit of the present disclosure but are illustrative, and the scope of the technical spirit of the present disclosure is not limited by the embodiments of the present disclosure.

The scope of the present disclosure should be construed by the claims, and it will be understood that all the technical spirits within the equivalent range are fall within the scope of the present disclosure.

What is claimed is:

1. A light distributing device for a vehicle comprising:

a focusing lens that concentrates light input to a rear surface thereof to form an image point on a front side thereof;

a shield that is arranged at the image point and has an opening through which a portion of the light, which passes through the image point, passes; and a mirror that reflects at least a portion of the light that passed through the opening to the front side of the focusing lens.

2. The light distributing device of claim 1, wherein a front surface of the focusing lens is a flat surface and the shield is parallel to the front surface of the focusing lens.

3. The light distributing device of claim 1, wherein the shield has a plurality of openings.

4. The light distributing device of claim 1, wherein the focusing lens, the shield, and the mirror are arranged in a sequence of the focusing lens, the shield, and the mirror along a direction in which the light input to the rear surface of the focusing lens is output.

5. The light distributing device of claim 1, wherein a front surface of the focusing lens is a flat surface and the mirror is perpendicular to the front surface of the focusing lens.

6. The light distributing device of claim 1, wherein the mirror comprises a reflective surface that reflects the light that passes through the image point and the reflective surface of the mirror is spaced apart from an optical axis of the focusing lens by a predetermined distance.

7. The light distributing device of claim 1, further comprising:

a collimator lens that is arranged on a rear side of the focusing lens to output the light input to a rear surface thereof as parallel rays.

8. The light distributing device of claim 7, wherein a front surface of the focusing lens is a flat surface, the rear surface of the collimator lens is a flat surface, and the front surface of the focusing lens and the rear surface of the collimator lens are parallel to each other.

9. The light distributing device of claim 1, further comprising:

a projection lens that is arranged on the front side of the focusing lens.

10. The light distributing device of claim 9, wherein a front surface of the focusing lens is a flat surface, the rear surface of the projection lens is a flat surface, and the front surface of the focusing lens and the rear surface of the projection lens are parallel to each other.

11. The light distributing device of claim 9, wherein the focusing lens forms a focus on the front side thereof, and the focus is situated between the projection lens and the focusing lens.

12. The light distributing device of claim 9, wherein the focusing lens, the shield, the mirror, and the projection lens are arranged in a sequence of the focusing lens, the shield, the mirror, and the projection lens along a direction in which the light input to the rear surface of the focusing lens is output.

13. The light distributing device of claim 1, wherein one side of the mirror is attached to the shield.

14. The light distributing device of claim 1, wherein the mirror and the shield are perpendicular to each other.

15. The light distributing device of claim 1, wherein the shield comprises a main shield that has an opening, and a mirror shield which blocks a portion of the opening and on which the mirror is mounted.

16. The light distributing device of claim 1, wherein a seating part protrudes from the shield and the mirror is seated on the seating part.

17. The light distributing device of claim 1, further comprising:

a mirror elevating device that elevates the mirror.

18. The light distributing device of claim 1, further comprising:

a mirror rotating device that rotates the mirror about a rotational axis, wherein the rotational axis is perpendicular to the shield.

19. The light distributing device of claim 1, further comprising:

a mirror rotating device that rotates the mirror about a rotational axis, wherein the rotational axis is parallel to an optical axis of the focusing lens.

20. A vehicle comprising the light distributing device claimed in claim 1.

* * * * *